US008884722B2

(12) United States Patent
Mohajer-Iravani et al.

(10) Patent No.: US 8,884,722 B2
(45) Date of Patent: Nov. 11, 2014

(54) INDUCTIVE COUPLING IN TRANSVERSE ELECTROMAGNETIC MODE

(76) Inventors: Baharak Mohajer-Iravani, San Jose, CA (US); Mahmoud Amin El Sabbagh, San Jose, CA (US)

( * ) Notice: Subject to any disclaimer, the term of this patent is extended or adjusted under 35 U.S.C. 154(b) by 564 days.

(21) Appl. No.: 12/695,739

(22) Filed: Jan. 28, 2010

(65) Prior Publication Data

US 2010/0188171 A1 Jul. 29, 2010

Related U.S. Application Data

(60) Provisional application No. 61/206,307, filed on Jan. 29, 2009, provisional application No. 61/216,471, filed on May 18, 2009, provisional application No. 61/233,800, filed on Aug. 13, 2009, provisional application No. 61/249,472, filed on Oct. 7, 2009.

(51) Int. Cl.

| | |
|---|---|
| ***H01P 1/201*** | (2006.01) |
| ***H01P 7/06*** | (2006.01) |
| ***H01P 1/205*** | (2006.01) |
| ***H01P 1/203*** | (2006.01) |
| ***H01P 1/20*** | (2006.01) |

(52) U.S. Cl.

CPC ..... *H01P 1/205* (2013.01); *H01P 1/2053* (2013.01); *H01P 1/203* (2013.01); *H01P 1/2005* (2013.01)

USPC ..... 333/202; 333/204; 333/227

(58) Field of Classification Search

USPC ..... 333/202–207, 212, 174, 227, 230

See application file for complete search history.

(56) References Cited

U.S. PATENT DOCUMENTS

| | | | | | |
|---|---|---|---|---|---|
| 2,964,718 | A | * | 12/1960 | Packard | 333/204 |
| 3,153,209 | A | * | 10/1964 | Kaiser | 333/204 |
| 3,516,030 | A | * | 6/1970 | Brumbelow | 333/212 |
| 4,151,494 | A | * | 4/1979 | Nishikawa et al. | 333/204 |
| 4,307,357 | A | * | 12/1981 | Alm | 333/206 |
| 4,489,292 | A | * | 12/1984 | Ogawa | 333/202 |
| 4,890,078 | A | * | 12/1989 | Radcliffe | 333/134 |
| 5,541,560 | A | * | 7/1996 | Turunen et al. | 333/207 |
| 6,081,175 | A | * | 6/2000 | Duong et al. | 333/212 |
| 6,597,259 | B1 | * | 7/2003 | Peters | 333/134 |
| 6,597,265 | B2 | * | 7/2003 | Liang et al. | 333/204 |
| 6,812,813 | B2 | * | 11/2004 | Mizoguchi et al. | 333/204 |
| 7,034,633 | B2 | * | 4/2006 | Passiopoulos et al. | 333/116 |

(Continued)

FOREIGN PATENT DOCUMENTS

| | | | |
|---|---|---|---|
| JP | 06097702 | A * | 4/1994 |
| KR | 10-2001-0045252 | | 6/2001 |
| KR | 10-2001-0097912 | | 11/2001 |
| KR | 10-2008-0079246 | | 8/2008 |

OTHER PUBLICATIONS

International Search Report & Written Opinion issued in PCT application No. PCT/US2010/022388, mailed Aug. 17, 2010, 10 pages.

*Primary Examiner* — Dean O Takaoka
*Assistant Examiner* — Alan Wong
(74) *Attorney, Agent, or Firm* — Fish & Richardson P.C.

(57) ABSTRACT

Among other things, a circuit includes a first and a second electromagnetic resonator, each configured to operate in a transverse electromagnetic mode, and a coupling device configured to operate in the transverse electromagnetic mode, wherein the coupling device is connected to the first and second electromagnetic resonators and inductively couples the first and second electromagnetic resonators.

49 Claims, 33 Drawing Sheets

(56) References Cited

U.S. PATENT DOCUMENTS 7,109,829 B2 * 9/2006 Kosaka et al. ..... 333/204
7,538,641 B2 * 5/2009 Baliarda et al. ..... 333/219
2007/0001786 A1 1/2007 Kundu

* cited by examiner

INDUCTIVE COUPLING IN TRANSVERSE ELECTROMAGNETIC MODE

CLAIM OF PRIORITY

This application claims priority to Provisional Patent Application Ser. No. 61/206,307, filed on Jan. 29, 2009, and Provisional Patent Application Ser. No. 61/216,471, filed on May 18, 2009, and Provisional Patent Application Ser. No. 61/233,800, filed on Aug. 13, 2009, and Provisional Patent Application Ser. No. 61/249,472, filed on Oct. 7, 2009, the entire contents of which are all hereby incorporated by reference.

BACKGROUND

This disclosure relates to inductive coupling in transverse electromagnetic mode.

Many electronic devices operate at relatively high frequencies. For example, some devices transmit, receive, and process electromagnetic signals in the microwave range of frequencies, where the signals may range from 300 MHz to 300 GHz. These devices often incorporate frequency filters and other components that are configured to operate at these frequencies in an optimal fashion.

SUMMARY

In a general aspect, a circuit includes a first and a second electromagnetic resonator, each configured to operate in a transverse electromagnetic mode, and a coupling device configured to operate in the transverse electromagnetic mode, wherein the coupling device is connected to the first and second electromagnetic resonators and inductively couples the first and second electromagnetic resonators.

Aspects can include one or more of the following features. The coupling device may be directly connected to the first and second electromagnetic resonators. The first resonator may be a cavity resonator. The first resonator may be a planar resonator. The coupling device may be inserted through an opening in a wall shared by the first and second electromagnetic resonators. The first electromagnetic resonator may be a single-mode resonator. The first electromagnetic resonator may be a multi-mode resonator. The first electromagnetic resonator may be one of a combine resonator, a folded-line resonator, an interdigital resonator. The first electromagnetic resonator may operate in a different mode than the second electromagnetic resonator. The coupling device may be configured to convey a signal from the first resonator to the second resonator. The coupling device may be configured to convey the signal across a magnetic field. The magnetic field may be dominant in strength relative to an electric field. The coupling device may include a conductive transmission line. The coupling device may include a metallic material. The coupling device may include a strip. The geometry of the strip may include one of a straight shape, meandering shape, a fractal shape, and a spiral shape. The coupling device may include a bar. The coupling device may include a rod. The coupling device may include a cylindrical structure. The first electromagnetic resonator may be configured to operate in a range of radio frequencies. The first electromagnetic resonator may be configured to operate in the range of microwave frequencies. The first and second electromagnetic resonators may be synchronously tuned. The first and second electromagnetic resonators may be asynchronously tuned. The first resonator may be tuned in at least one of an electrical, mechanical, or magnetic manner. The first and second resonators may form a portion of an active component. The first and second resonators may form a portion of a passive component. The first and second resonators may form a portion of a symmetric component. The first and second resonators may form a portion of an asymmetric component. The first electromagnetic resonator and the coupling device may be formed in a substrate. The first electromagnetic resonator, the second electromagnetic resonator and the coupling device may be formed in a substrate. The first electromagnetic resonator may have a length of less than one quarter of the wavelength at the resonant frequency of the first electromagnetic resonator.

In another general aspect, an apparatus includes a planar frequency filter formed in a dielectric substrate, and having a first and a second planar resonator, each configured to operate in a transverse electromagnetic mode, and at least one feed line connected to the first planar resonator and being capable of providing a signal to the first planar resonator, and an inductive planar coupling strip connected to the first and second planar resonators, wherein the inductive planar coupling strip is configured to operate in a transverse electromagnetic mode and is capable of conveying portions of the signal from the first planar resonator to the second planar resonator.

Aspects can include one or more of the following features. The inductive planar coupling strip may be configured to convey the signal across a magnetic field. The first planar resonator may have a length of less than one quarter of the wavelength at the resonant frequency of the first planar resonator In yet another general aspect, an apparatus includes an inductive coupling device configured to connect at least two resonators, each resonator configured to operate in a transverse electromagnetic mode.

Aspects can include one or more of the following features. The coupling device may be configured to convey a signal across a magnetic field. At least one of the two resonators may have a length of less than one quarter of the wavelength at the resonant frequency of the one of the two resonators.

Advantages and other features of the invention will become apparent from the following description, and from the claims.

DESCRIPTION

Radio-frequency filters, including filters operating at microwave frequencies, may incorporate resonators intended to operate over a wide band of frequencies. The resonators may operate in transverse electromagnetic mode (TEM mode) or quasi-TEM mode. In TEM mode, electromagnetic signals travel in a direction perpendicular to their associated electric and magnetic fields. In quasi-TEM mode, electromagnetic signals travel in a direction perpendicular to strong components of their associated electric and magnetic fields, but in the same direction as weak components of the fields.

TEM mode resonators can be coupled using a spacing or gap between a pair of resonators so that electromagnetic signals will travel from one resonator to the other over the gap through a magnetic or electric field which can be modeled as inductance or capacitance, respectively. However, this type of coupling is impractical when the desired coupling value is very high and the associated gap between the resonators is very small. For example, the gap between two resonators might be a tenth of a millimeter or less. The strength of the coupling depends on the configuration and dimensions of both the resonators and the coupling section including the gap size, so the resonators should be precisely manufactured and positioned relative to each other. This level of precise manufacturing can be costly or even impractical if the precision tolerances are beyond the capabilities of state of the art fabrication technology. Thus, some configurations of resonators such as electrically small resonators may not have sufficiently strong coupling if a gap is used for the coupling.

Figure 1:
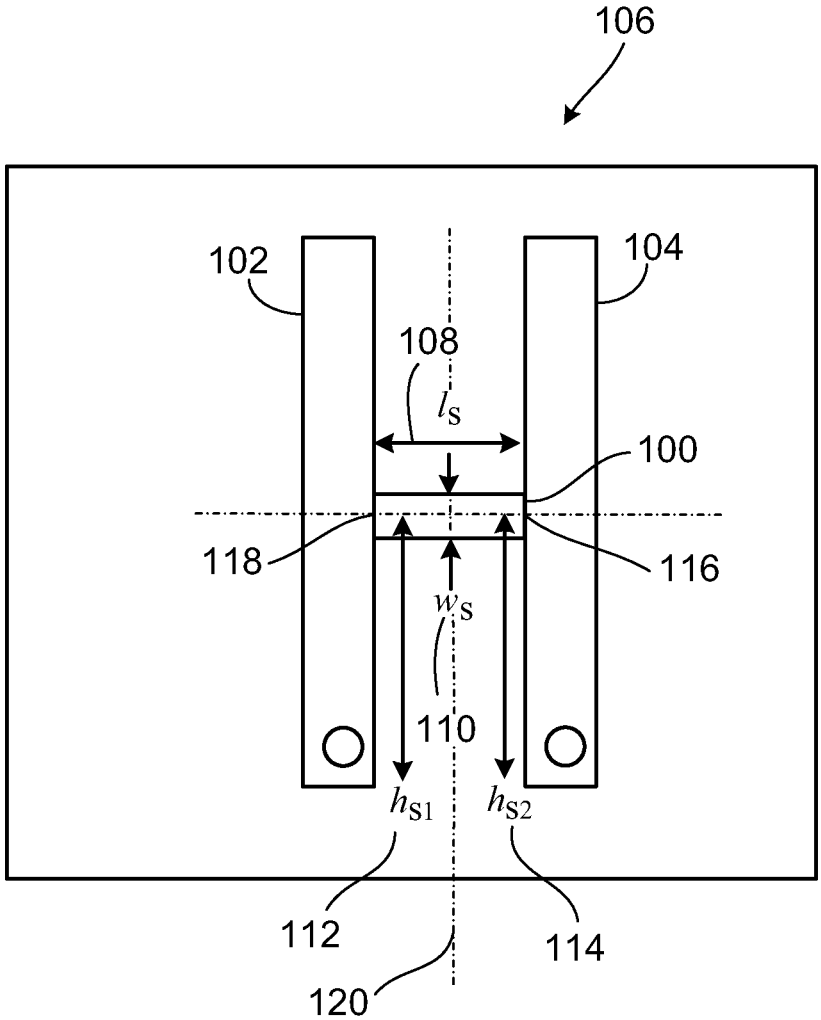
FIG. 1 shows a pair of resonators that includes a coupling device.

FIG. 1 shows an example of a coupling device 100 in the form of a transmission line that inductively couples two combline resonators 102, 104 to form a coupled resonator configuration 106. This coupled resonator configuration 106 uses a direct connection to couple the resonators. The coupling device 100 operates in a TEM mode that overrides the decaying TEM mode in the gap between the resonators. The coupling to provided by the coupling device 100 is much stronger than the coupling provided by the gap.

The coupling device 100 can be used to strongly couple resonators of any size, including very small resonators. For example, the resonators could have a length in the range of $\lambda_0/4$, where $\lambda_0$ is the wavelength at the resonant frequency of the resonator. However, the resonators could also have a length of an even smaller fraction of the resonant frequency wavelength, for example, or could have a length of many times the resonant frequency wavelength. The configuration and size of the resonators do not impact the strength of the coupling provided by the coupling device 100 compared to coupling provided by a gap, and so the configuration and size can be freely chosen based on other design considerations.

The coupling can be controlled by the design parameters of the coupling section including the length 108 of the coupling device 100, its width 110, and the center of its tapped-in junctions 116, 118 along both resonators 102, 104. Further, once the positions 112, 114 of the coupling device 100 are fixed, its width 110 and length 108 can be optimized to achieve a desired coupling value. The coupling provided by the coupling device 100 may also be affected by the material composing the device. For example, the coupling device 100 may be a metal or composed of a metallic material.

As an example, the relationship between coupling strength and the corresponding design parameters of the coupling device 100 are as follows. The coupling increases by increasing the width 110 of the coupling device 100, or by decreasing the length 108 of the coupling device 100, or by locating the coupling device farther away from shorted ends of the resonators 102, 104, which corresponds to raising the positions 112, 114.

In addition, increasing length 108 of the coupling device is not necessarily equivalent to increasing the spacing between resonators 102, 104. For example, it is possible to fit a relatively long coupling device 100 in the shape of a meandered strip within a small spacing gap. The geometry of the coupling device 100 can have any of several two-dimensional and three-dimensional geometries. Other examples are a fractal strip, or spiral strip, a bar, a rod, a cylindrical structure, or any other shape that supports a TEM mode.

The use of the coupling device 100 allows for a wide range of coupling values from weak (close to zero) up to strong (close to unity) values. The associated attenuation constant is nearly zero ($\alpha \approx 0$), so electromagnetic waves that propagate by way of the coupling generally remain intact. Further, the resonant frequency for resonators coupled using the coupling device 100 can be significantly higher than the resonant frequency of each individual resonator 102, 104. The resonant frequency follows the same trend as the coupling, so a stronger coupling results in a higher resonant frequency. Therefore, when the coupling device 100 provides for strong inter-resonator coupling, the coupling device 100 can be used in creating very wideband electrical components.

This coupling technique can be used in the design of various electrical components and devices, for example, frequency filters or other kinds of devices made of coupled resonators. These electrical devices may operate in a variety of frequency ranges including radio frequency (RF), microwave, millimeter-wave, and higher in the frequency spectrum. The technique can be used to provide a wide range in coupling strengths (coupling values) between different configurations of resonators that can be reliably manufactured with precision. Some types of devices that use this coupling technique may include filters, diplexers which are composed of two filters, duplexers which are composed of switches and filters, multiplexers which are composed of several filters, group delay equalizers which are terminated filters, couplers, antennas, and so on.

Resonators 102, 104 coupled using the coupling device 100 can be arranged in various alignments, including, for example, a straight line, folded path, random alignment, or other alignment. Different possible configurations of resonators 102, 104 within the coupled resonator configuration 106 include, for example, combline resonators, interdigital resonators, folded-line resonators, slow-wave-structure resonators, multiple-mode-structure resonators, a mixture of combline and interdigital resonators, a mixture of combline and folded-line resonators, a mixture of interdigital and folded-line resonators, a mixture of combline, interdigital, and folded-line resonators, a mixture of multiple-mode-structure and single-mode-structure resonators, and other configurations that operate in TEM mode or quasi-TEM mode.

Other examples of electrical components using resonators coupled with the coupling device 100 are possible. The physical structure of resonators 102, 104 can be planar or cavity. The resonators can be synchronously or asynchronously tuned. The total structure of the coupled resonator configuration 106 can be symmetric or asymmetric. A coupled resonator configuration 106 can be tuned electrically, mechanically, or magnetically and can be active or passive. Cavity resonators can be fabricated using precise machining or any multilayer planar technology such as printed circuit board (PCB) and low temperature co-fired ceramic (LTCC) based on microwave laminates. Lower loss and higher permittivity of laminates may reduce insertion loss and dimensions of the components. In general, resonators, which are the building blocks of electrical components, may be miniaturized physically and/or electrically by means of available size reduction methods. The components can be fabricated using any available manufacturing technology such as PCB, LTCC, radio-frequency microelectromechanical systems (RF-MEMs), and nano-technology.

In examples of electrical components using TEM/quasi-TEM single-mode resonators, the coupling between two adjacent and consecutive resonators, i.e., ith and (i+1)th resonators, introduces poles in the frequency response. These poles can define the bandwidth and insertion loss. These consecutive couplings can be all either inductive or capacitive as the signs of coupling values in coupling matrix are all the same (either all positive or all negative). Further, cross-coupling or coupling between non-adjacent resonators affects the selectivity and introduces zeros in the frequency response. The cross-coupling can be either capacitive or inductive according to their respective signs in the coupling matrix. The elements of the coupling matrix are either all inductive or all capacitive if all the coupling values have the same sign (either all negative or all positive). A positive sign shows inductive (magnetic) coupling and a negative sign shows the capacitive (electric) coupling. Thus, the elements of the coupling matrix are a mixture of inductive and capacitive elements if the signs of elements are different.

Also, a coupled resonator configuration 106 could have mixture of resonators coupled with a gap and resonators coupled with the coupling device 100. Further, the coupled resonator configuration 106 may have input/output coupling that includes feed lines tapped into input/output resonators or transformers coupled to input/output resonators through a spacing gap, in which case the structure can function as an electrical component.

Figure 2:
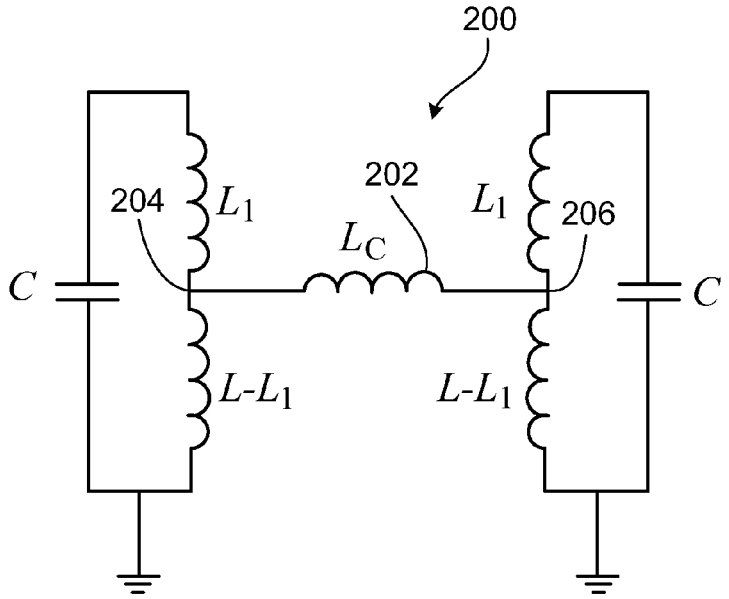
FIGS. 2-5 shows circuit models corresponding to the pair of resonators of FIG. 1

FIG. 2 shows a circuit model 200 of the coupled resonator configuration 106 of FIG. 1. The coupling device 100 can be modeled as an inductor 202. For simplicity, the metallic and dielectric losses are not reflected in the circuit model 200. The unloaded resonant frequency $F_0$ of each individual resonator 102, 104 is modeled as parallel combination of inductance L and capacitance C where $F_0=1/(2\pi\sqrt{LC})$. L and C represent the equivalent inductance and capacitance of the resonator, respectively. $L_1$ is the inductance of the partial length of a resonator between the junctions 116, 118 of direct connection of the coupling device 100 to the resonator and the open end of each resonator. This part of the resonator has a length $d=l-h_S$ where $h_S=h_{S1}=h_{S2}$ as shown in FIG. 1. l is the total length of each resonator. The coupling strip is modeled as a pure inductance $L_C$. The capacitance between coupling strip and ground is not included in order to simplify the modeling. The inductance $L_C$ is connected to the inductances L at locations 204, 206 which corresponds to junctions 116, 118 and this divides the resonator inductance.

The coupling strip inductance $L_C$ decreases by decreasing strip length $l_s$ or increasing its width $w_s$. The inductance $L_1$ decreases by increasing $h_s$ or decreasing d.

Figure 3:
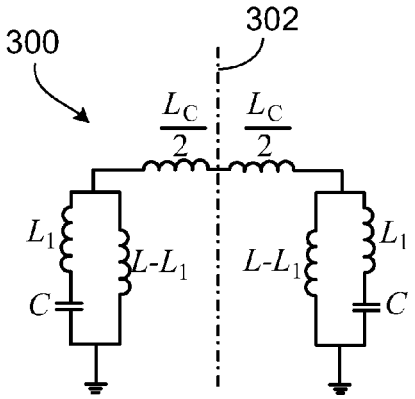

FIG. 3 shows a circuit model 300 which is rearranged form of circuit model 200 in FIG. 2. This model can be used to compute the coupling value, k, of the coupling device 100 between two symmetric resonators 102, 104.

Figure 4:
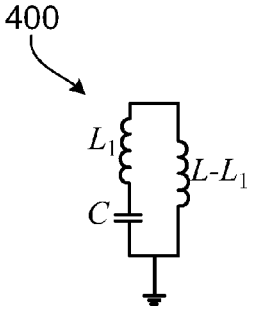
Figure 5:
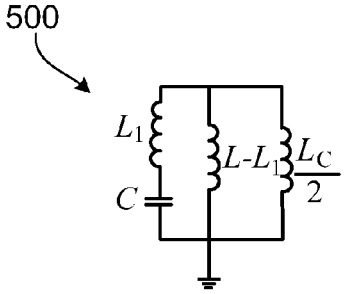

The coupling value k and the corresponding resonant center frequency $f_0$ are computed by solving only half of the circuit model 300, marked with symmetry plane 302, for the two cases corresponding to a circuit with even symmetry 400 as shown in FIG. 4 and a circuit with odd symmetry 500 as shown in FIG. 5. An analysis of the circuit model with even or odd symmetry is equivalent to the numerical study of a coupled resonator configuration 106 as shown in FIG. 1 with an exemplary ideal magnetic wall or ideal electrical wall, respectively, placed at the symmetry plane 120. The resonant frequencies of the circuit due to even and odd symmetries can be determined and denoted as magnetic resonance $f_m$ and electric resonance $f_e$, respectively. In addition, k and $f_0$ are related to these resonances as follows:

$$k=(f_e^2-f_m^2)/(f_e^2+f_m^2)$$

$$f_0=\sqrt{f_e f_m}.$$

The resonant frequency of the circuit with even symmetry 400 is $f_m=F_0$. Thus, the magnetic resonance does not change with loading. The resonant frequency of the circuit with odd symmetry 500 is $$f_e=1/2\pi\sqrt{L_e C}$$

$$L_e=L_1+\{(L-L_1)\|0.5L_C\}$$

where the symbol || indicates a parallel combination. $L_e$ is the equivalent electric inductance of a circuit with odd symmetry. Further, $L_e$ is less than L. Hence, $f_e>F_0$ or $f_e>f_m$ and this indicates that the coupling with a direct connection is inductive (k>0).

$f_e$ increases by decreasing $L_e$ and $f_e$ dominantly affects k and $f_0$. This is explained through the first-order derivative of these parameters with respect to $f_e$ as follows:

$$\partial k/\partial f_e=4f_e f_m^2/(f_e^2+f_m^2)^2$$

$$\partial f_0/\partial f_e=0.5\sqrt{f_m/f_e}.$$

The derivatives in these equations are positive. Thus, the coupling and the resonant center frequency increase with an increase of electric resonant frequency.

The inductance $L_e$ is a function of the two variables $L_1$ and $L_C$. The first-order derivative of $L_e$ with respect to $L_1$ indicates the effect of $L_1$ on $L_e$ as follows:

$$\partial L_e/\partial L_1=1-(L_C/D)^2$$

where $D=2(L-L_1)+L_C$. D is always greater than $L_C$ and $(L_C/D)<1$. Therefore, this derivative is always positive and its value decreases as $L_1$ increases.

Figure 6:
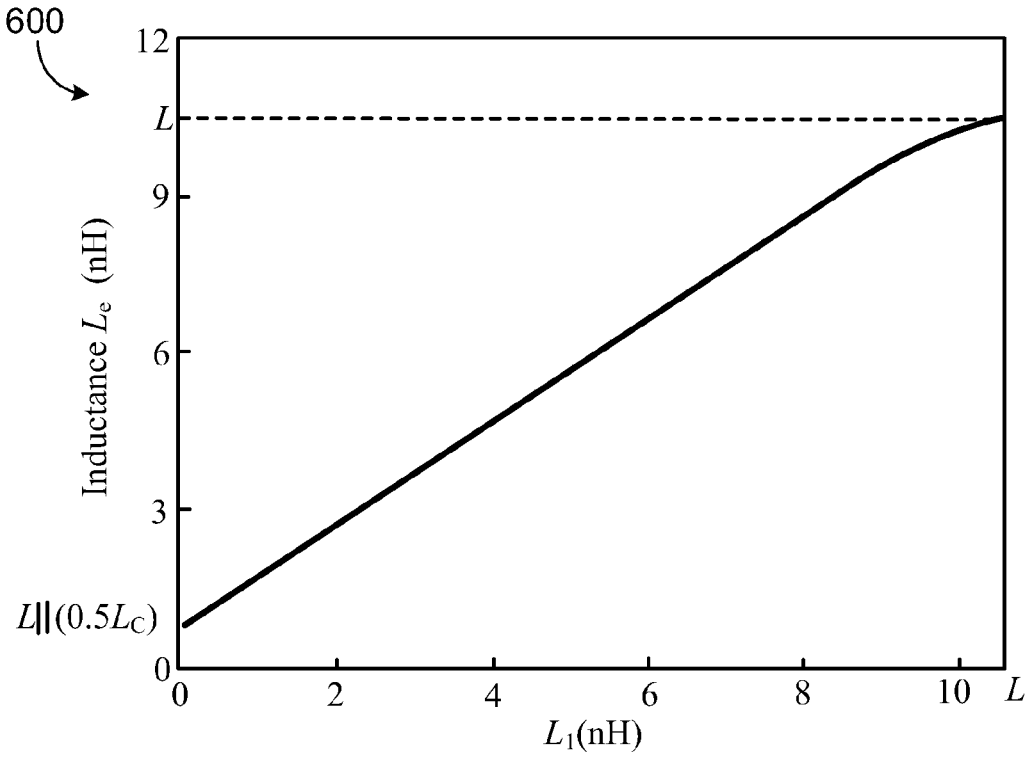
FIGS. 6-7 is a graph of equivalent inductance.

FIG. 6 is a graph 600 showing that $L_e$ continuously increases versus $L_1$. $L_e$ changes from $[L\|(0.5L_C)]$ to L as $L_1$ increases from 0 to L. The first-order derivative of $L_e$ with respect to $L_C$ shows the behavior of $L_e$ versus $L_C$. This derivative is $$\partial L_e/\partial L_C=2((L-L_1)/D)^2.$$

The slope of $L_e$ is positive, yet it decreases with increasing $L_C$ (i.e. D increases).

Figure 7:
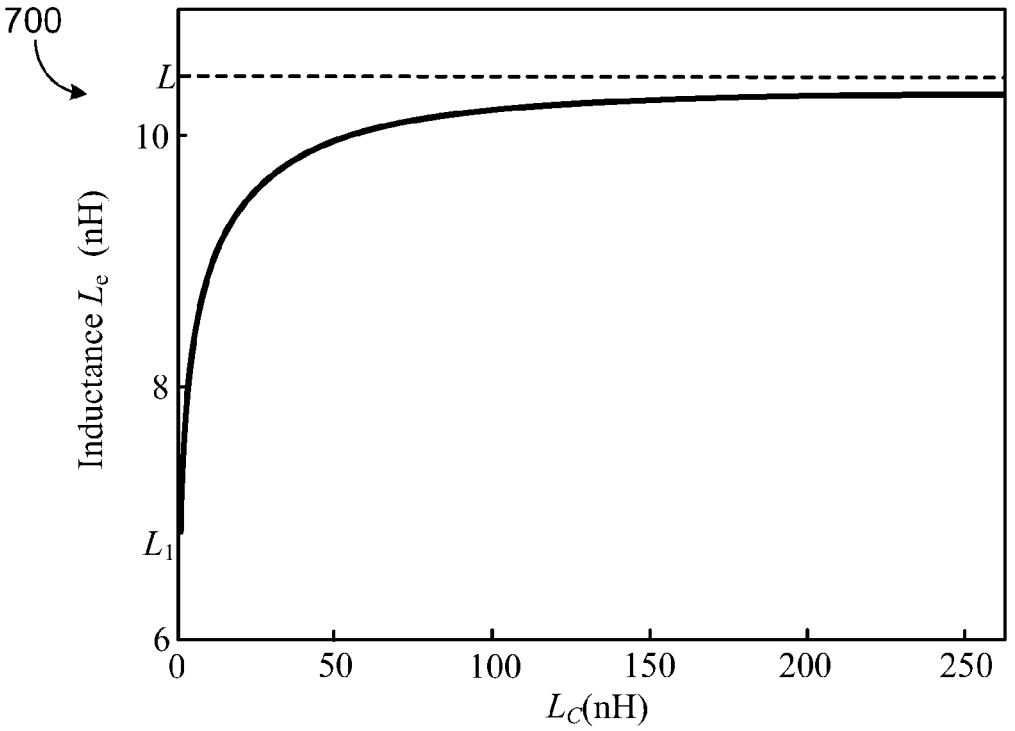

Therefore, as shown in FIG. 7 in a graph 700, $L_e$ increases by increasing $L_C$. As $L_C$ varies from 0 to ∞, $L_e$ changes from $L_1$ to the asymptote value L. The values of the lumped elements in the circuit model used to plot these figures are L=10.44 nH and C=1.16 pF which results in an unloaded resonant frequency $F_0$=1.45 GHz, $L_C$=1.74 nH, and $L_1$=6.73 nH.

Thus, as $L_1$ or $L_C$ decreases, $L_e$ decreases; $f_e$ increases; and both k and $f_0$ increase in accordance with the equations provided above.

Figure 8:
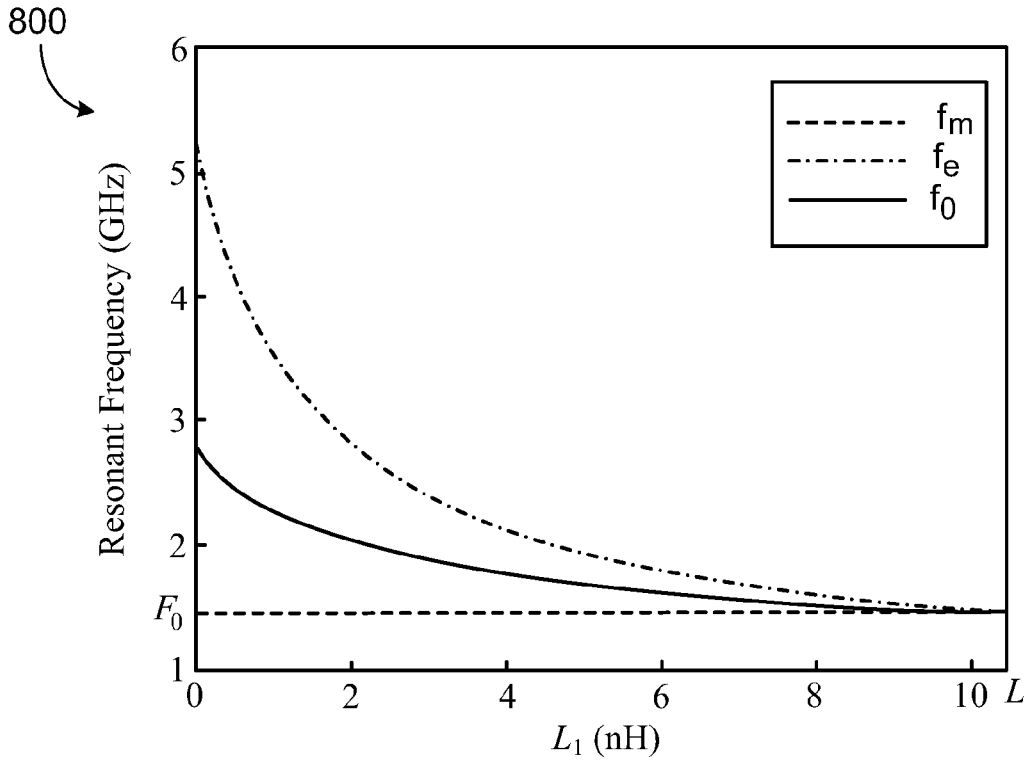
FIG. 8 is a graph of resonant frequencies.

FIG. 8 shows a graph 800 of $f_m$, $f_e$, and $f_0$ versus $L_1$.

Figure 9:
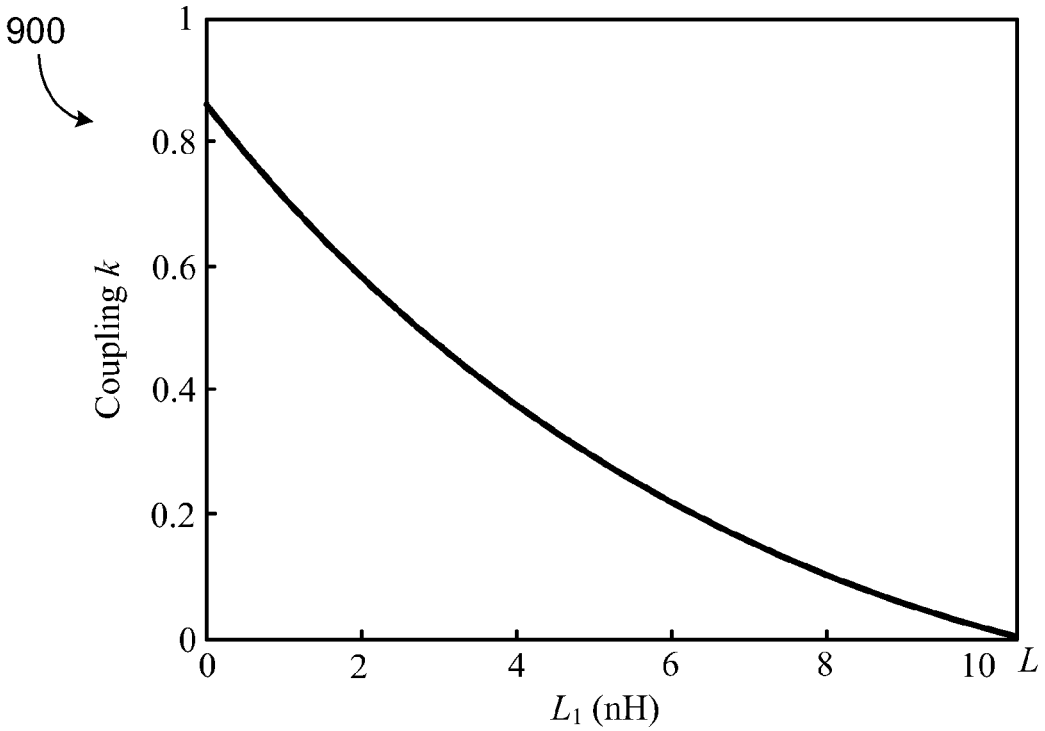
FIG. 9 is a graph of coupling values.

Further, FIG. 9 shows a graph 900 of the coupling k versus $L_1$. The coupling curve illustrates that it is possible to realize a broad range of coupling values from nearly zero up to unity based on the direct connection provided by the coupling device. In the example shown in FIG. 9, the maximum achieved coupling is equal to 0.85 and the minimum coupling theoretically goes to zero as $L_1$ asymptotically reaches L, which indicates uncoupled resonators. The resonant frequency follows the same trend as coupling. A significant change of resonant frequency versus $L_1$ is shown in FIG. 8. The large variation of resonant frequency mostly occurs at small values of $L_1$ providing strong coupling. The appropriate selection of lumped-element values, based on the design curves in FIGS. 8 and 9, provides the coupling and resonant frequency and allows for flexibility in controlling and adjusting the bandwidth of various electrical components such as filters from narrowband up to ultra-wideband.

Figure 10:
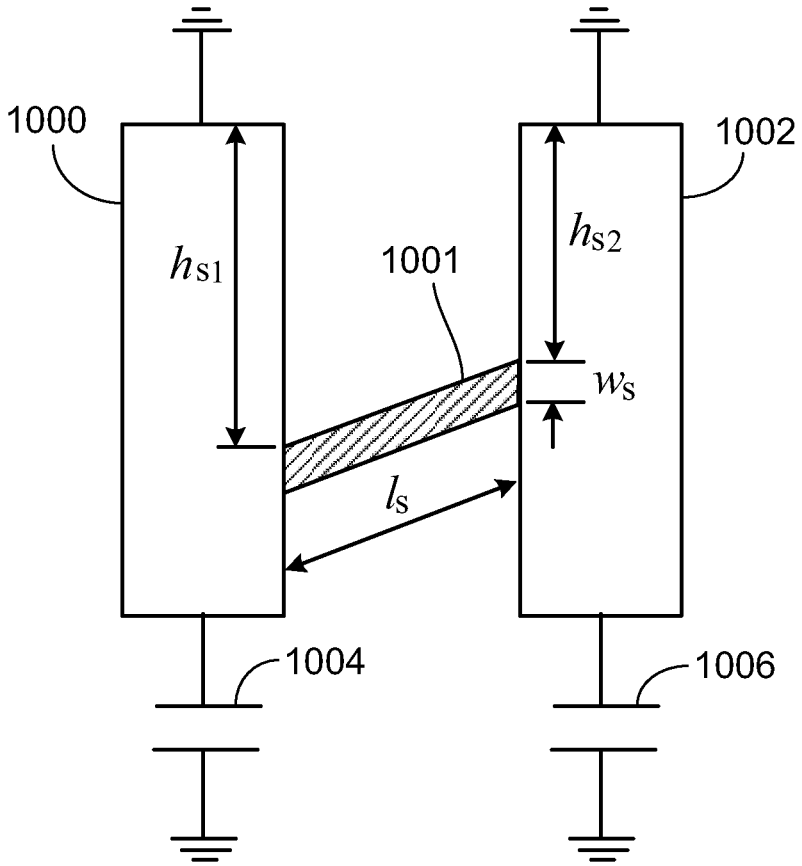
FIGS. 10-17 show pairs of resonators that includes a coupling device.
Figure 11:
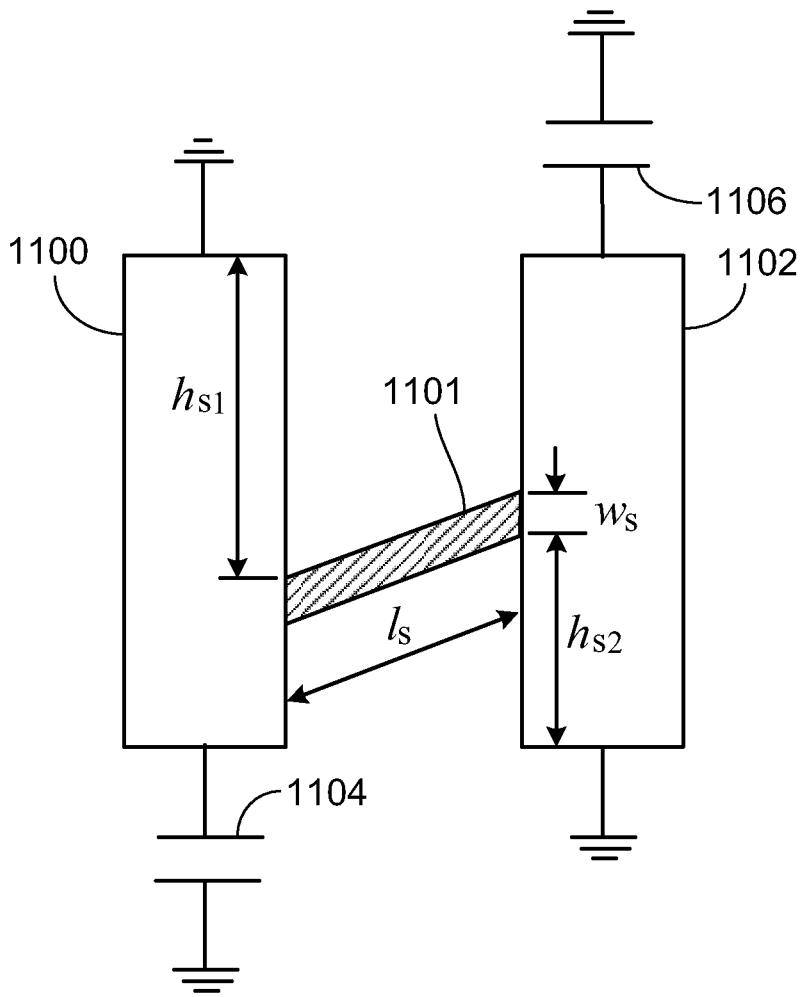

The coupling device can be used to couple resonators belonging to any of several different types. FIG. 10 shows the coupling device 1001 being used to couple planar combline resonators 1000, 1002 loaded by capacitances 1004, 1006 at the resonators' open ends. Similarly, FIG. 11 shows the coupling device 1101 used to couple planar interdigital resonators 1100, 1102 loaded by capacitances 1104, 1106 at the resonators' open ends.

Figure 12:
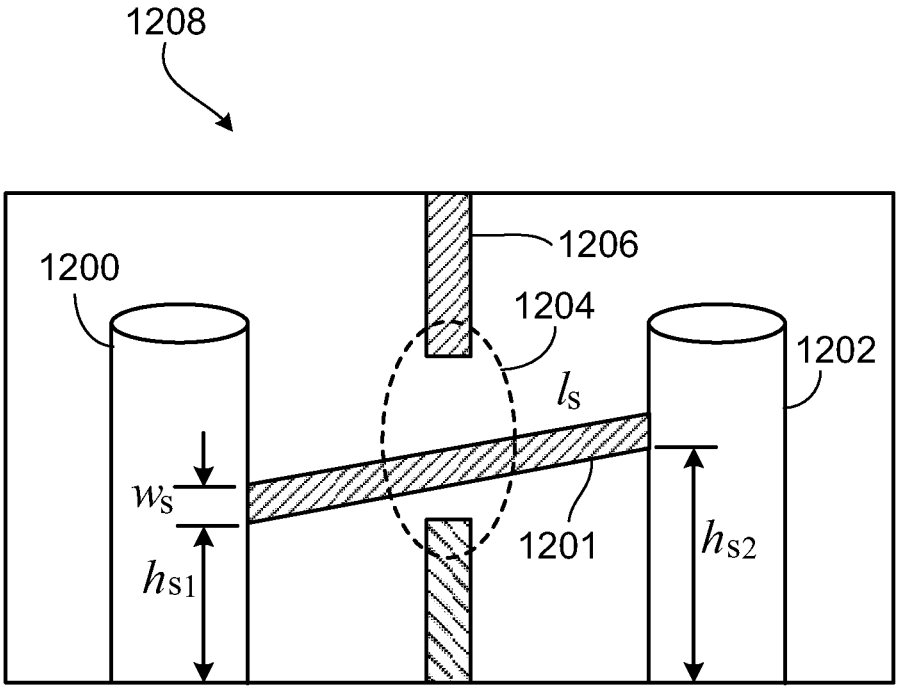

The coupling device can also be used to couple cavity resonators, which may take the form of rods or bars. FIG. 12 shows the coupling device 1201 coupling two cavity-based combline resonators 1200, 1202 by traversing an iris 1204 in a cavity wall 1206 to form a coupled resonator configuration 1208. In this exemplary configuration, the coupling device 1201 provides for a greater range of coupling values between the resonators than would otherwise be possible with the conventional types of coupling only through an inductive iris 1204 in a cavity wall 1206. The conventional coupling between resonators operates in evanescent modes where the corresponding electromagnetic-field components have a zero phase constant (β=0) and a non-zero attenuation constant (α≠0). However, the coupling device 1201 between resonators 1200, 1202 operates in TEM mode. The electromagnetic-field components of the TEM mode have a non-zero phase constant (β≠0) and only material losses contribute to the attenuation constant (α≈0). Additionally, in some implementations, a coupled resonator configuration 1208 incorporating cavity resonators 1200, 1202 can have a spacing between resonators without a common wall where the coupling is enhanced using the stronger coupling provided by the coupling device 1201. The location and dimensions of the coupling device 1201 and iris 1204 determine the coupling value.

Figure 13:
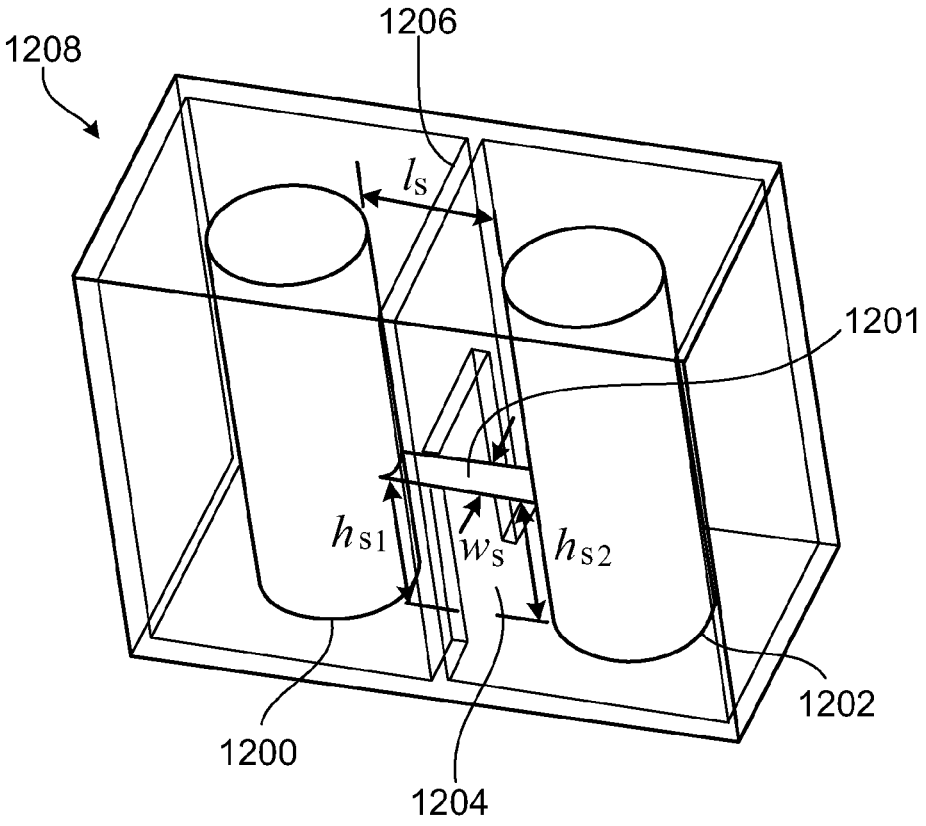

FIG. 13 shows a three-dimensional view of the coupled resonator configuration 1208 of FIG. 12.

Figure 14:
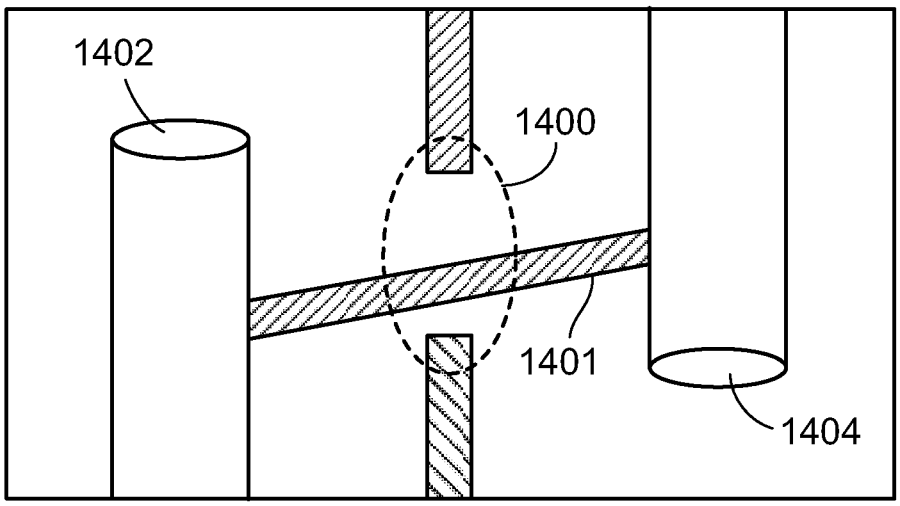
Figure 15:
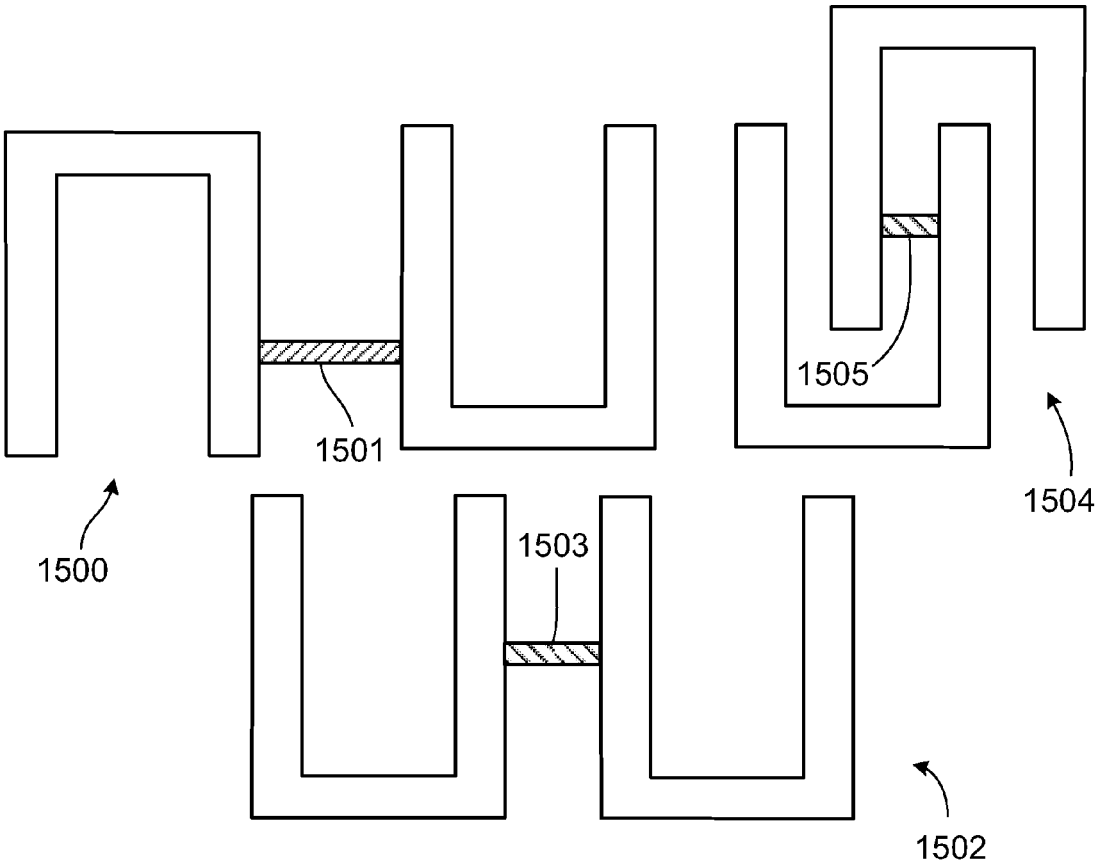

FIG. 14 shows another example of the coupling device 1401 traversing an inductive iris 1400 to couple two cavity-based interdigital resonators 1402, 1404. Many other configurations of electronic components incorporating the coupling device are possible. For example, FIG. 15 shows several coupled resonator configurations 1500, 1502, 1504 having planar folded-line resonators coupled using the coupling device 1501, 1503, 1505. One coupled resonator configuration 1500 has resonators side by side in opposite orientation, one coupled resonator configuration 1502 has resonators side by side in the same orientation, and one coupled resonator configuration 1504 has resonators interleaved.

Figure 16:
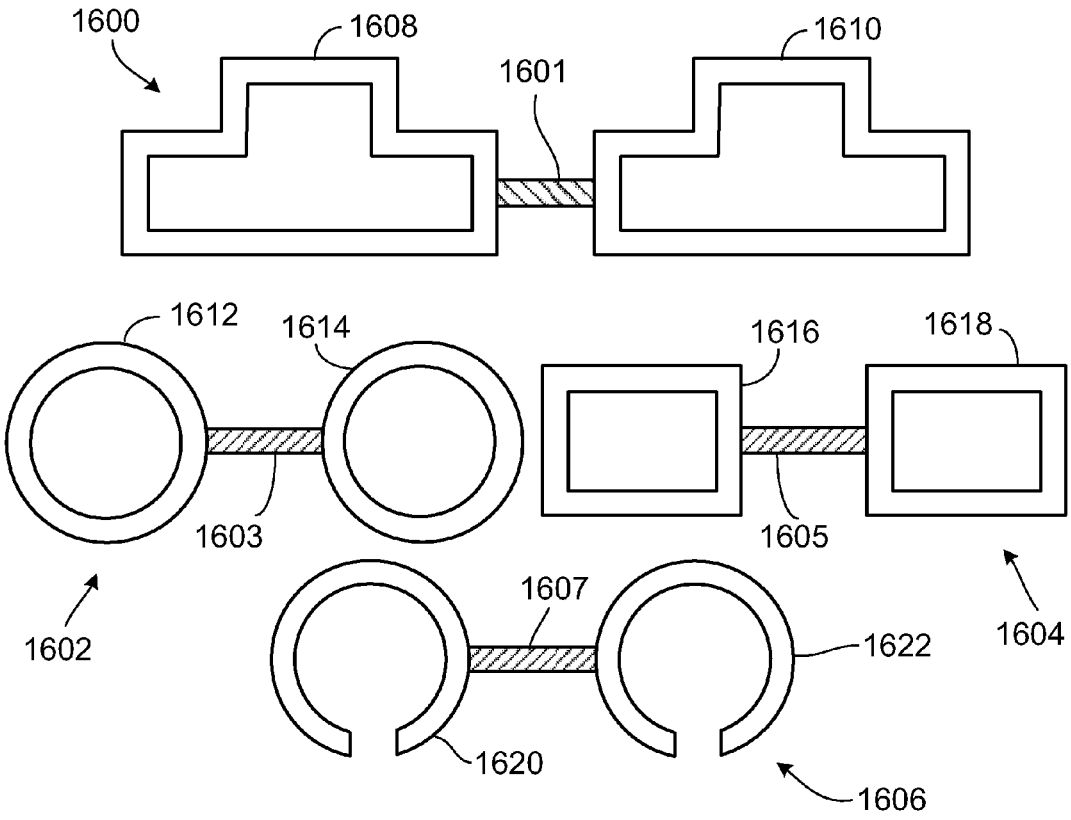

FIG. 16 shows further examples of coupled resonator configurations 1600, 1602, 1604, 1606 that incorporate the coupling device 1601, 1603, 1605, 1607. In this case, the resonators are slow-mode resonators. One coupled resonator configuration 1600 includes fractal resonators 1608, 1610, another coupled resonator configuration 1.602 includes circular-ring resonators 1612, 1614, another coupled resonator configuration 1604 includes rectangular-ring resonators 1616, 1618, and another coupled resonator configuration 1606 includes split-ring resonators 1620, 1622.

Figure 17:
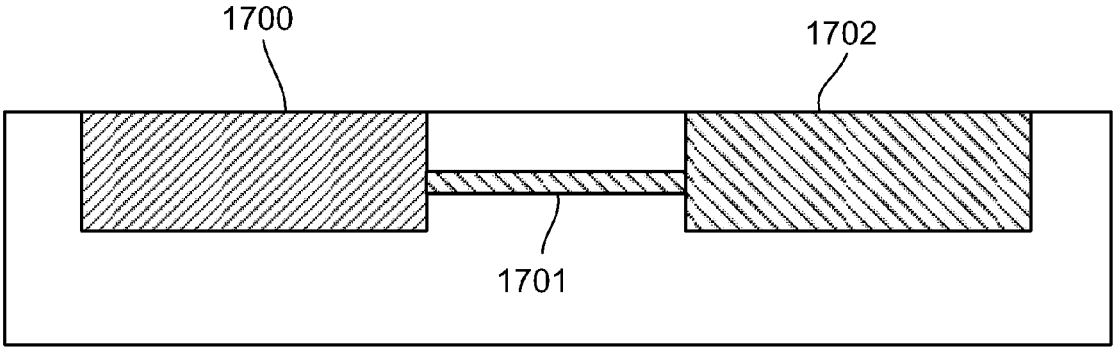

This type of coupling device can be used in applications for creating coupling between other types of resonators operating in modes other than TEM or quasi-TEM such as transverse electric (TE) mode. An example of this case is shown in FIG. 17, in which the coupling device 1701 is used to couple ridge waveguide resonators 1700, 1702. The ridge waveguide resonators operate in transverse electric mode.

Figure 18B:
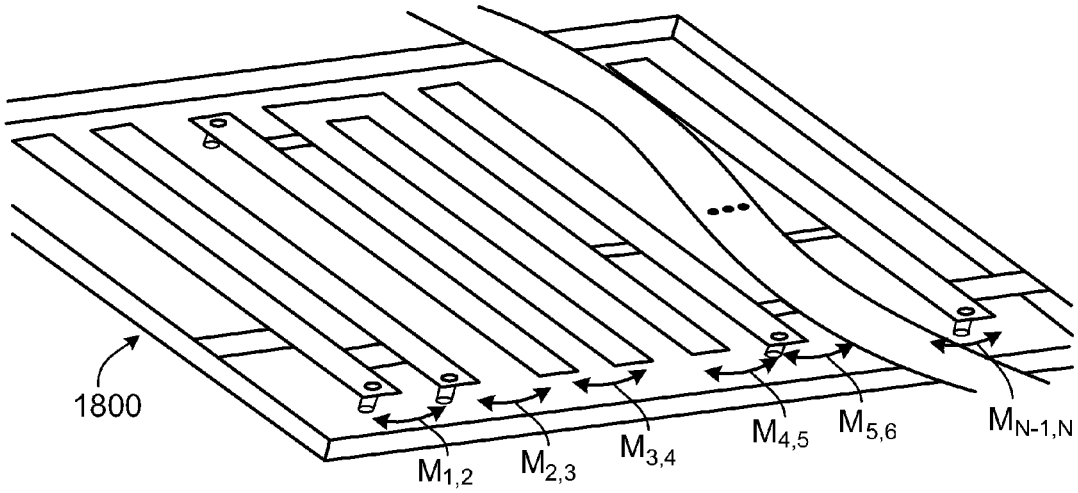
FIGS. 18A-19B show electronic components that include multiple coupling devices.
Figure 18A:
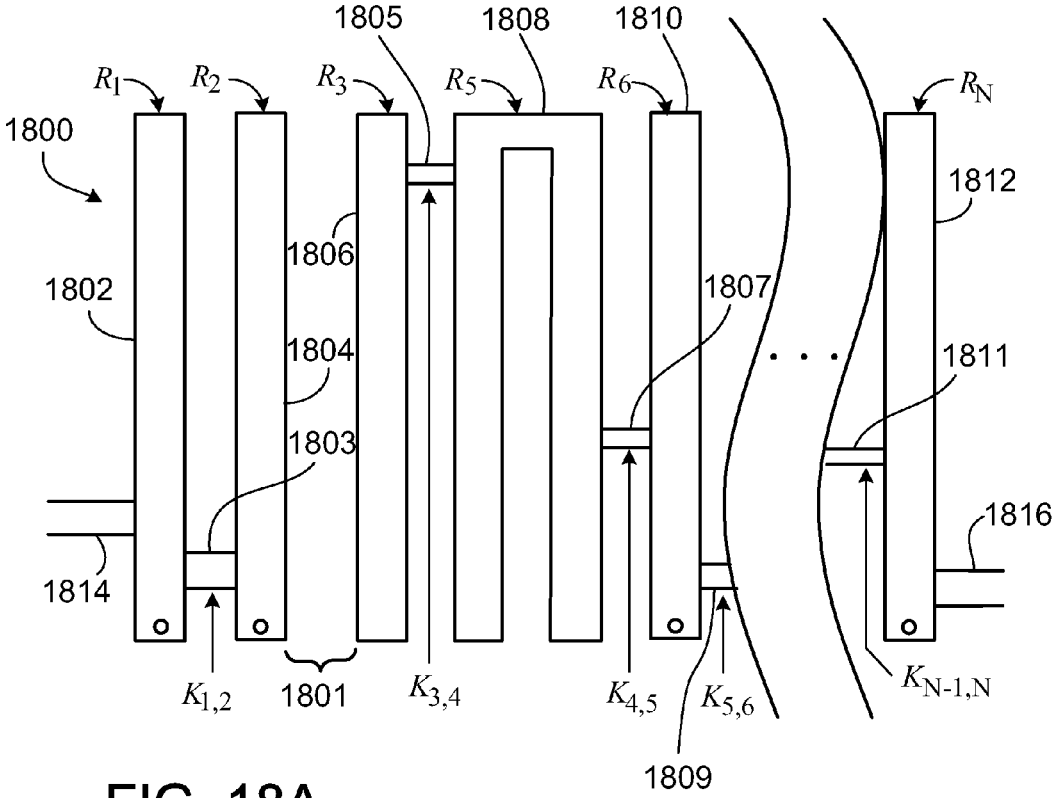

FIG. 18A shows one configuration of an all-pole planar asymmetric filter 1800 in a straight alignment with resonators 1802, 1804, 1806, 1808, 1810, 1812 coupled using instances of the coupling device 1803, 1805, 1807, 1809, 1811 and conventional coupling through a gap 1801 using a combination of two coupling schemes. This filter 1800 is asymmetric in structure, and resonators are arranged longitudinally (along a straight line). There is a single input feed line 1814 and single output feed line 1816. The feed lines 1814, 1816 are directly connected to the first resonator 1802 and last resonator 1812, respectively. Further, because this filter 1800 is composed of a mixture of N combline, interdigital, and folded resonators, the filter is an N-pole filter. N is the total number of resonators, and the ith resonator is denoted as $R_i$ where $1 \le i \le N$. In this particular example, only adjacent resonators are coupled. However, other implementations may have resonators coupled in other configurations. The coupling value between adjacent resonators $R_i$ and $R_{i+1}$ is $M_{i,i+1}$ in the coupling matrix. The instances of the coupling device 1803, 1805, 1807, 1809, 1811 substantially determine the coupling value. The instances operate in a fundamental quasi-TEM mode and are labeled as $K_{i,i+1}$. In this example, coupling $M_{2,3}$ between resonators 1804, 1806 is realized via conventional coupling through a gap 1801 that operates in quasi-TEM-decaying mode. Therefore, the coupling matrix for this exemplary filter 1800 is produced based on a combination of quasi-TEM inductive coupling over a gap, and quasi-TEM inductive coupling using the coupling device 1803, 1805, 1807, 1809, 1811. FIG. 18B shows a three-dimensional view of the same configuration of FIG. 18A.

Figure 19B:
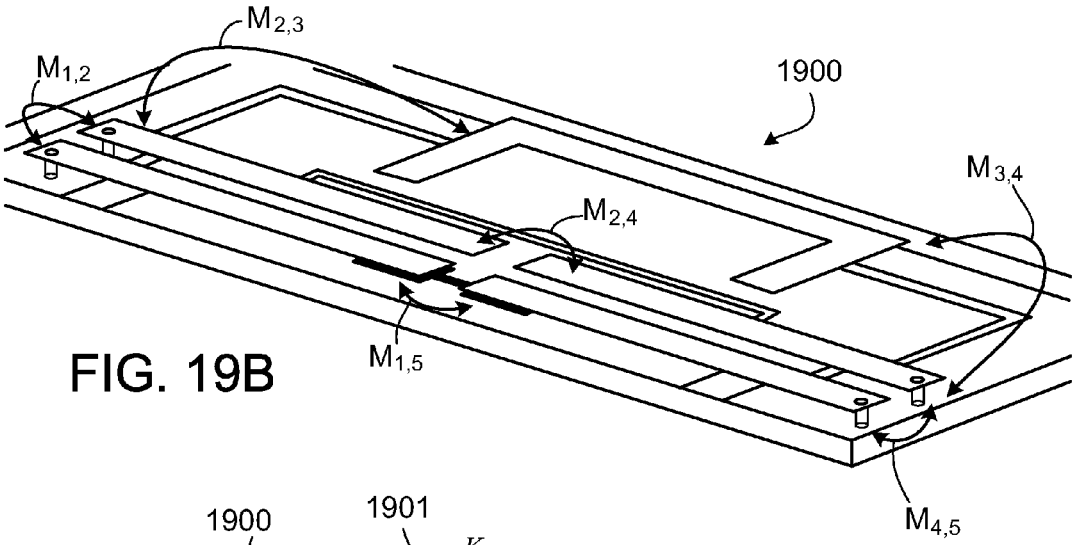
Figure 19A:
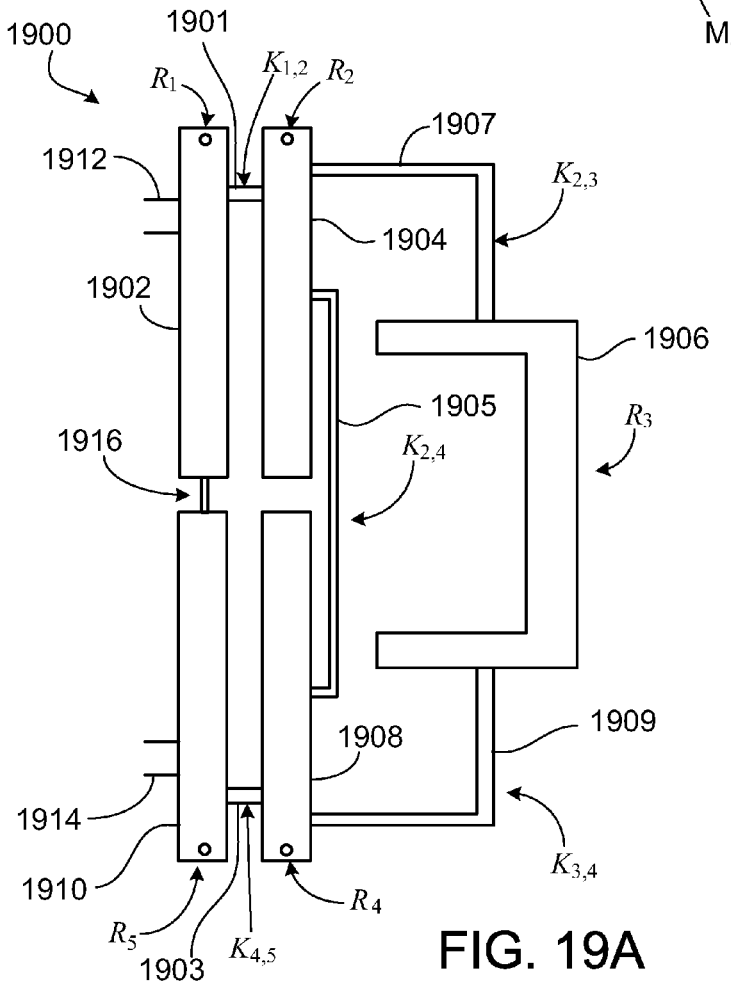

FIG. 19 shows an example of a quasi-elliptic planar symmetric filter 1900 in a folded alignment with resonators 1902, 1904, 1906, 1908, 1910 coupled using instances of the coupling device 1901, 1903, 1905, 1907, 1909 and a capacitive coupling probe 1916. This filter 1900 has five poles (N=5) and two transmission zeros. The filter 1900 has a symmetric-folded configuration with a mixture of combline resonators 1902, 1904, 1908, 1910 and folded-line resonators 1906. The input/output feed lines 1912, 1914 are directly connected to the first and last resonators, respectively. All couplings, either adjacent or cross coupling, are performed by different instances of the coupling device 1901, 1903, 1905, 1907, 1909. However, the cross coupling between one resonator 1902 and another resonator 1910 is a capacitive coupling, also known as probe coupling. The coupling probe 1916 interfaces with embedded parallel-plate capacitances created at the open end of resonators. The other coupling sections are inductive and realized by directly connecting the instances of the coupling device 1901, 1903, 1905, 1907, 1909 in the form of strips between resonators. FIG. 19B shows a three-dimensional view of the same configuration of FIG. 19A.

Figure 20:
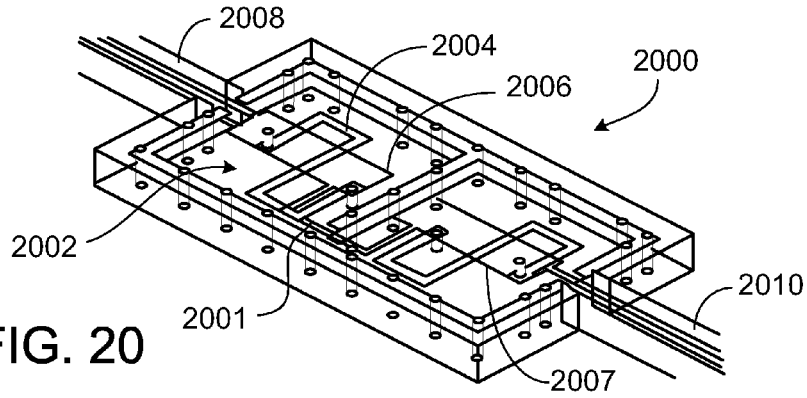
FIGS. 20-23 show printed circuit board layouts of an electronic component that includes the coupling device.

FIG. 20 shows a printed circuit board layout 2000 of a miniaturized two-pole cavity combline bandpass filter with miniaturized resonators coupled with instances of the coupling device 2001. This layout 2000 could be used in fabricating a printed circuit board using planar multilayer technology.

The cavity combline resonators are miniaturized using fractal structures and capacitive loadings. For comparison, an example of a conventional machined-cavity combline filter might have a rod and a capacitive loading at the rod open end along with a tuning screw. In the example shown in FIG. 20, these elements are replaced by a mushroom structure 2002. The mushroom structure 2002 can be implemented using multilayer technology and is composed of two main parts. The first part is a fractal structure 2004 built of a combination of two vias and a meandered strip which is vertically connected through different layers. This replaces the rod of a conventional structure. One end of the fractal structure 2004 is shorted to the bottom wall of cavity. The second part of the mushroom structure is a mushroom patch 2006 of rectangular shape which directly connects to the open end of the fractal structure 2004 and creates a parallel-plate capacitive loading with top and bottom walls of the cavity. In this implementation, the cavity is produced in the following manner. Top and bottom walls are made of two parallel planar metallic layers. The solid side walls are replaced with horizontal strips and closely spaced vertical vias stitching the top and the bottom walls together. The mushroom structure 2002 combline resonator is designed to resonate close to the lower edge of the filter passband.

The coupling device 2001 is used to achieve coupling values that might not be achieved by conventional gap coupling (also sometimes called evanescent coupling) through adjustment of an iris in the common wall between two cavities. The length, width, and location of the coupling device 2001 control the coupling strength. However, the vertical positioning of strip (i.e. the distance from ground) may depend on the thickness of the individual dielectric layers. Thus, any adjustment in the vertical location of the coupling device 2001 can also be followed by an adjustment or optimization of the horizontal position, length and width. Also, the synchronous or asynchronous cavity combline resonators can be tuned to resonate at the same or different frequencies, respectively, by adjusting the capacitive loadings at the resonators open ends. Similarly, the mushroom structure 2002 resonators can be tuned by reshaping the patches to vary the capacitances. 50-Ω feed lines 2008, 2010 are used for input/output coupling and are directly connected to the mushroom patches 2006, 2007.

Figure 21:
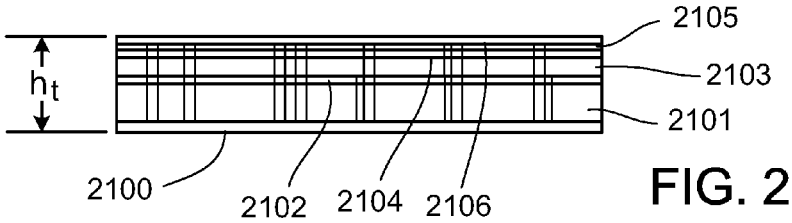

As shown in FIG. 21, the substrate of the PCB layout 2000 of FIG. 20 consists of four metallic layers 2100, 2102, 2104, 2106 and three dielectric layers 2101, 2103, and 2105. In this example, the thicknesses of the dielectric layers are 1.016 mm (40 mil) for the first dielectric layer 2101, 0.762 mm (30 mil) for the second dielectric layer 2103, and 0.254 mm (10 mil) for the third dielectric layer 2105. The layout of the first metallic layer 2100 and the fourth metallic layer 2106 are solid planes.

Figure 22:
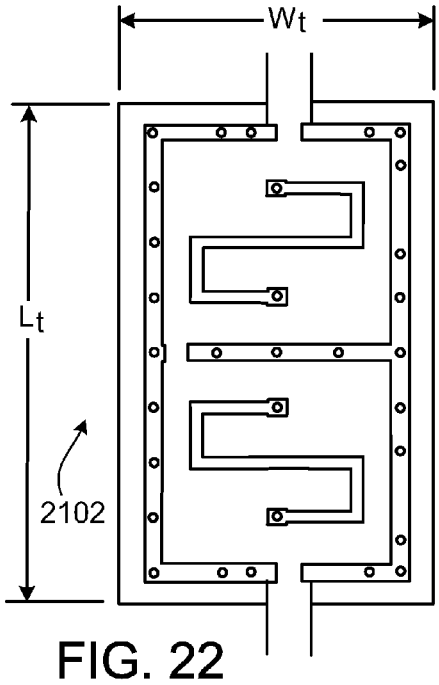

FIG. 22 shows the layout of the second metallic layer 2102. This second metallic layer 2102 includes pads for vias, meanders, and wall strips defining the horizontal boundaries for cavities.

Figure 23:
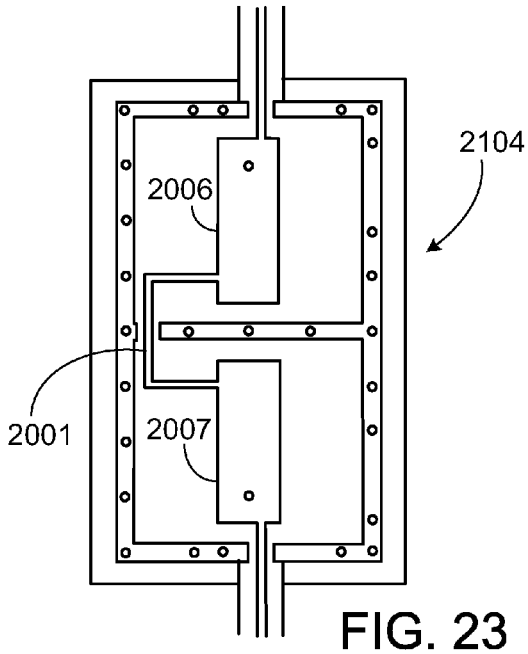

FIG. 23 shows the layout of the third metallic layer 2104. The third metallic layer 2104 has patches, wall strips, an instance of the coupling device 2001 directly connected to mushroom patches, and strips of input/output feed lines.

The total dimensions of the exemplary filter of the PCB layout 2000 are as follows: $W_t$=10.4 mm, $L_t$=20.1 mm, and $h_t$=2.032 mm. In this example, each individual resonator resonates at 880 MHz.

Figure 24:
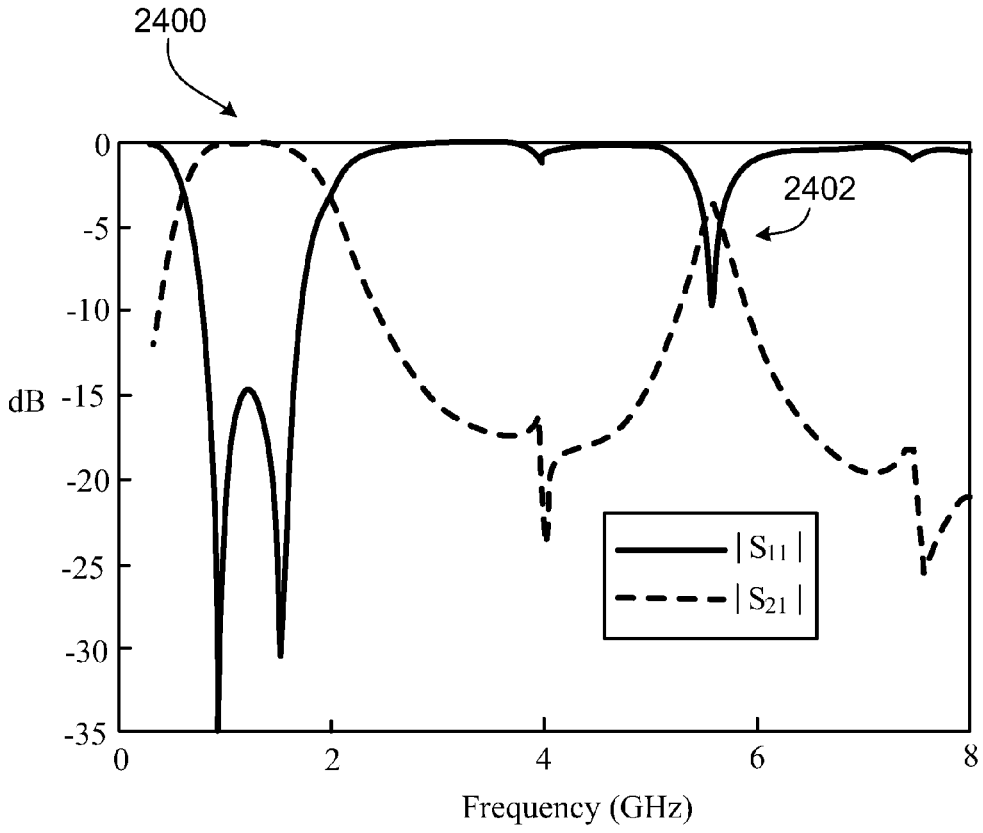
FIGS. 24-25 are graphs of frequency responses of electronic components.

FIG. 24 shows a graph 2400 of the frequency response of the filter represented by the PCB layout 2000. The filter has a wide bandwidth of 110%. The center frequency is 1290 MHz. The 3-dB bandwidth is from 610 MHz to 1970 MHz which corresponds to 3-dB bandwidth percentage of 110%, a return loss of 15 dB, and a midband insertion loss of 0.38 dB. This wideband filter also has a wider clean stopband due to miniaturization of resonators. The first spurious response 2402 of this filter appears at 4.26 times the center frequency. Also, in this example, the size of each cavity resonator is $\lambda/10\times\lambda/10\times\lambda/55$ at the center frequency. Thus, by reducing the electrical size of resonators in the filter, the spurious response 2402 is pushed away from the passband. With the use of the coupling device as compared to a conventional coupling, the strong coupling value with less sensitivity to design parameters between miniaturized resonators is satisfied. Therefore, the wideband filter with minimum number of resonators is designed. This means the total size of filter and the material losses are reduced.

Figure 25:
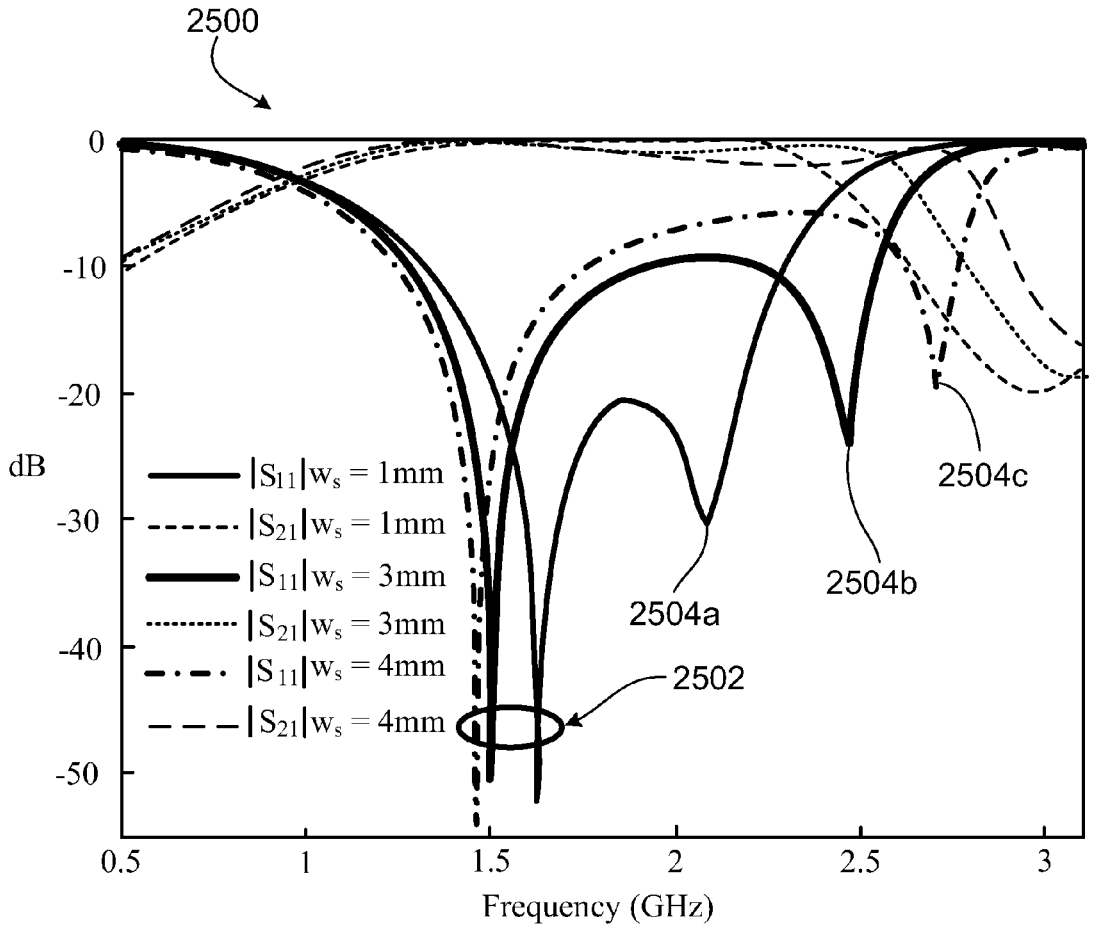

FIG. 25 shows a graph 2500 of the frequency response of different instances of a two pole filter that uses the coupling device to couple two similar combline resonators with input/output 5042 feed lines are loosely coupled to the resonators. In this example, coupling devices with widths of 1 mm, 3 mm, and 4 mm are used. In particular, three cases are shown, corresponding to the following dimensions: $h_S$=10.5 mm and $w_S$=1 mm, $h_S$=11.5 mm and $w_S$=3 mm, and $h_S$=12 mm and $w_S$=4 mm. The dimensions that remain constant for these three cases are w=2 mm, l=30 mm, $l_S$=2 mm, $r_v$=0.2032 mm, $d_v$=0.7032 mm and dielectric thickness is 1.524 mm, the relative dielectric constant $\in_r$ is 3.55, and the loss tangent tan δ is 0.0027. (Refer to FIG. 1 for an explanation of the dimensions.) As shown in FIG. 25, the first pole 2502 is at a frequency of approximately 1.5 GHz ($F_0$=1.5 GHz). As the width increases, the corresponding coupling value between resonators increases, and the second pole 2504*a*, 2504*b*, 2504*c* moves to a higher frequency.

Figure 26:
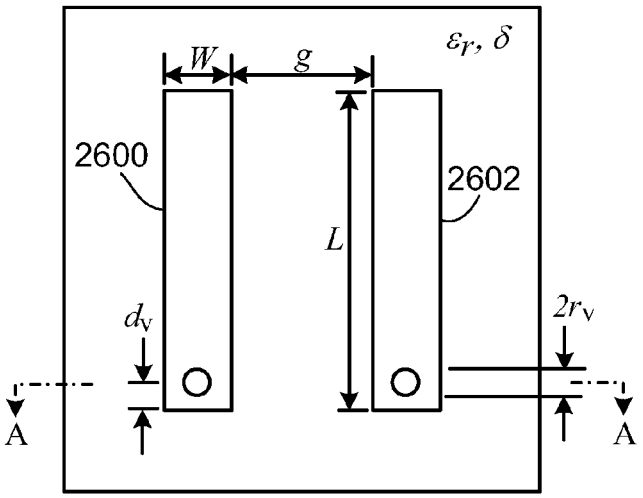
FIGS. 26-27 show a pair of resonators that uses gap coupling.
Figure 27:
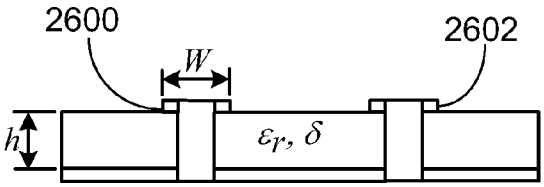
Figure 28:
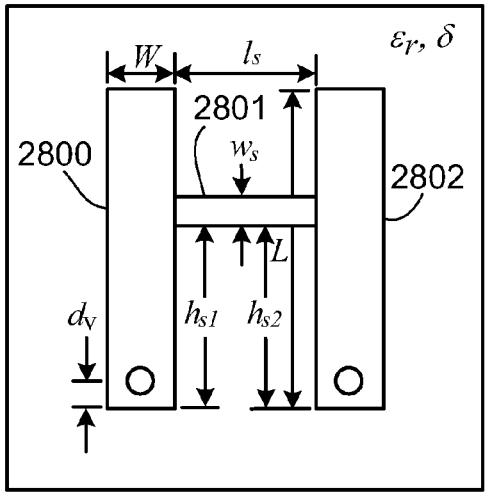
FIG. 28 shows a pair of resonators that includes a coupling device.

Resonator configurations using similar resonators can have different characteristics based on the type of coupling used. For example, FIG. 26 shows a top view of a pair of planar combline resonators 2600, 2602 coupled using conventional gap coupling, and FIG. 27 shows a corresponding side view. FIG. 28 shows a top view of a pair of planar combline resonators 2800, 2802 coupled using the coupling device 2801. Although the first pair of resonators 2600, 2602 may have similar characteristics to the second pair of resonators 2800, 2802, they may exhibit different properties due to the difference in coupling.

Figure 29:
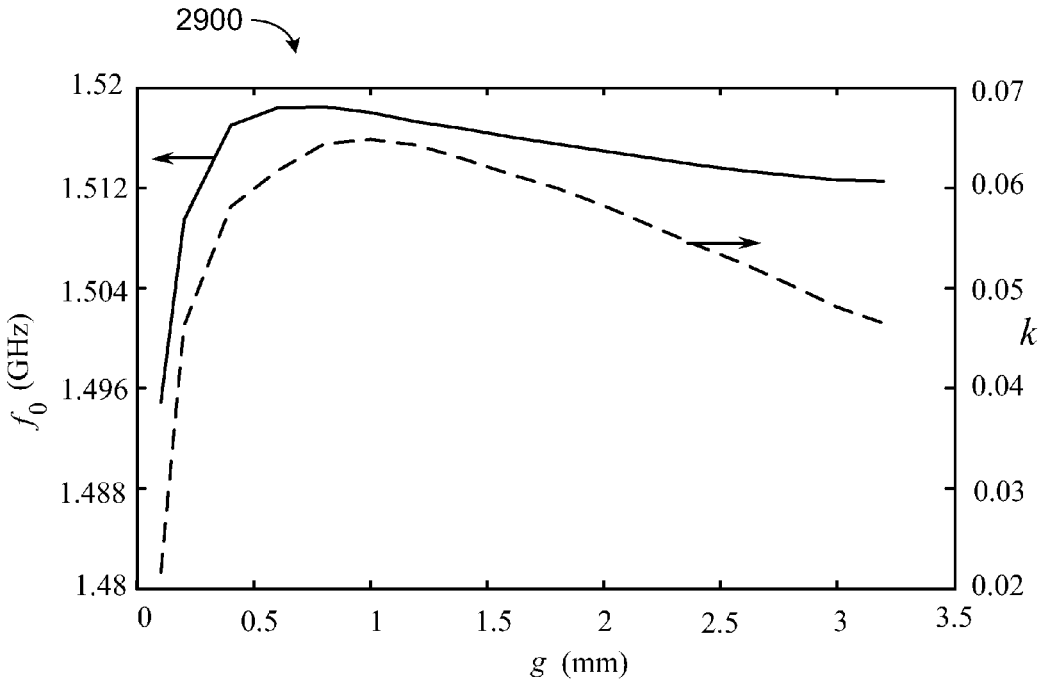
FIGS. 29-32 are graphs of coupling values and resonant frequency.

For example, FIG. 29 shows a graph 2900 of the magnetic coupling and resonant frequency versus the size of the gap, g, using the example shown in FIG. 26. The solid line is the resonant frequency $f_0$, and the dotted line is the magnetic coupling k.

The length and width of the combline resonators are adjusted to resonate at 1.5 GHz which may be the center frequency of a filter. In this example, the resonator width W is 2 mm, the resonator length L is 28.8 mm, the via radius $r_v$ is 0.2032 mm (8 mil), the via center is located at a distance $d_v$ of 0.7032 mm from the shorted edge of the resonator, the substrate thickness h is 1.524 mm (60 mil), the relative dielectric constant $\in_r$ is 3.55, and the loss tangent tan δ is 0.0027. The electrical length of each resonator is approximately 0.25 wavelength of the resonant frequency of the resonator.

The coupling and resonant frequency of two-coupled resonators can be computed using the following formulas, respectively:

$$k = \frac{f_e^2 - f_m^2}{f_e^2 + f_m^2}$$

$$f_0 = \sqrt{f_e f_m}$$

where $f_e$ and $f_m$ are the resonant frequencies obtained for the two cases where a perfect electric conductor and perfect magnetic conductor are placed at the symmetry plane between the two resonators, respectively. As shown in FIG. 29, when the gap is very small the electric coupling is strong and partially cancels out the magnetic coupling. As the size of the gap increases, the effect of the electric coupling diminishes. Similarly, the strength of the magnetic coupling is reduced and the resonant frequency decreases. The positive coupling values show that the coupling is dominantly of inductive nature. For varying values of g from 1.2 mm to 3.2 mm, $f_0$ decreases by 4 MHz which corresponds to a decrease of 0.27%. This means that the coupling through the gap has a minor effect on the resonant frequency. For the same range of g variation, k decreases from 0.065 to 0.046 which represents a 1.9% reduction in coupling. The following definitions for percentage changes in $f_0$ and k are used: $\Delta f_0\% = (f_{02} - f_{01}) \times 100/F_0$, where $F_0$=1.5 GHz is the resonant frequency of each individual resonator. $\Delta k\% = (k_2 - k_1) \times 100/k_{max}$, where $k_{max}$=1 is the maximum limit of inter-resonator coupling.

Because strong coupling values are difficult to obtain and tuning ranges of to coupling and resonant frequency versus the gap are small, a conventional gap coupling like the example in FIG. 29 may only be appropriate for some kinds of filter designs, such as those corresponding to a coupling matrix with weak entries. In this scenario, the filter bandwidth may be widened by adding more resonators, but this can lead to increased size, in-band loss, and circuit complexity.

Figure 30:
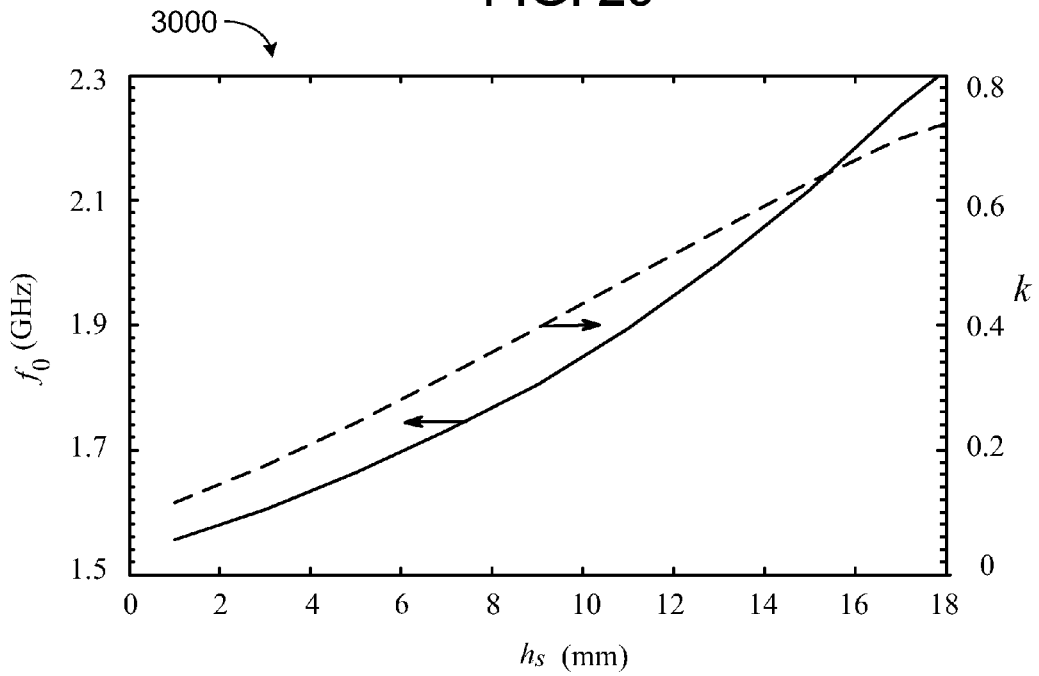

In contrast, FIG. 30 shows a graph 3000 of the magnetic coupling and resonant frequency versus the location, $h_s$, of the coupling device 2801 along the resonators of the example shown in FIG. 28. Again, the solid line is the resonant frequency $f_0$, and the dotted line is the magnetic coupling k.

In this example, the dimensions of the coupling strip are: width $w_s$=1 mm, length $l_s$=2.2 mm, and distances from shorted ends $h_{s1}=h_{s2}$=10 mm. In the graph shown in FIG. 30, the location of the coupling strip measured from the shorted ends of the resonators is varied such that $h_{s1}=h_{s2}=h_s$. Moving the location of direct connection away from the grounded end of the resonators increases the coupling and the resonant frequency. For the range of $h_s$ from 1 mm to 18 mm, $f_0$ increases from 1.56 GHz to 2.3 GHz which corresponds to a 49.3% increase. The variation of k from 0.11 to 0.68 represents a 57% increment.

FIG. 30 shows that a maximum coupling value using the coupling device is 0.72, in comparison to a maximum coupling of less than 0.065 for conventional gap coupling shown in FIG. 29. Similarly, the resonant frequency using the coupling device is higher than using conventional gap coupling.

Figure 31:
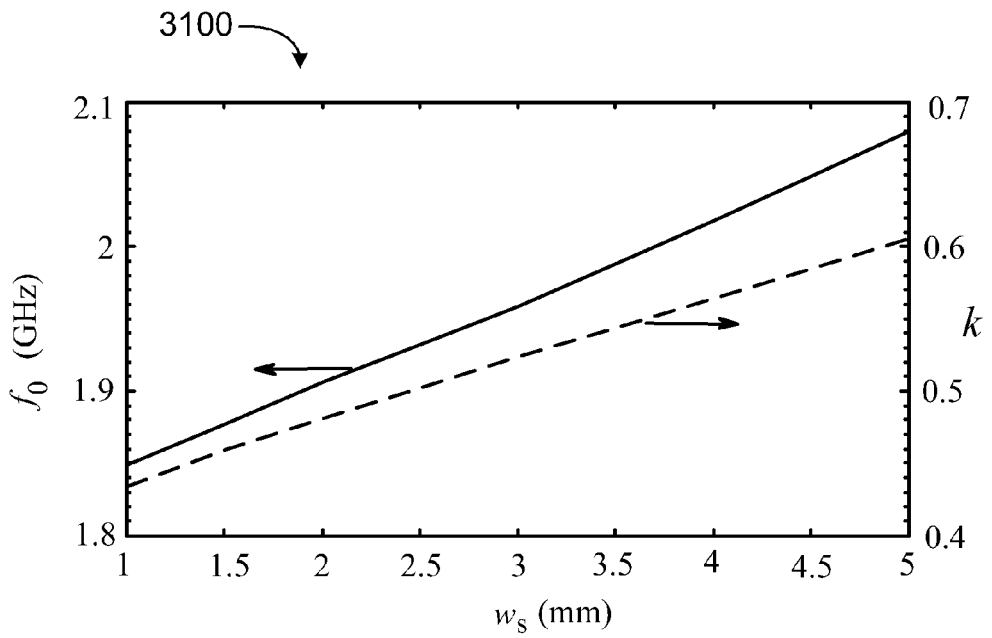

FIG. 31 shows a graph 3100 of the magnetic coupling and resonant frequency versus the width, $w_s$, of the coupling device 2801, as in the example shown in FIG. 28. Again, the solid line is the resonant frequency $f_0$, and the dotted line is the magnetic coupling k.

When the coupling device is widened, coupling and resonant frequency both increase. As $w_s$ increases from 1 mm to 5 mm, $f_0$ increases from 1.85 GHz to 2.08 GHz which represents an increase of 15.3%. k changes from 0.43 to 0.61, which corresponds to an 18% increment.

Figure 32:
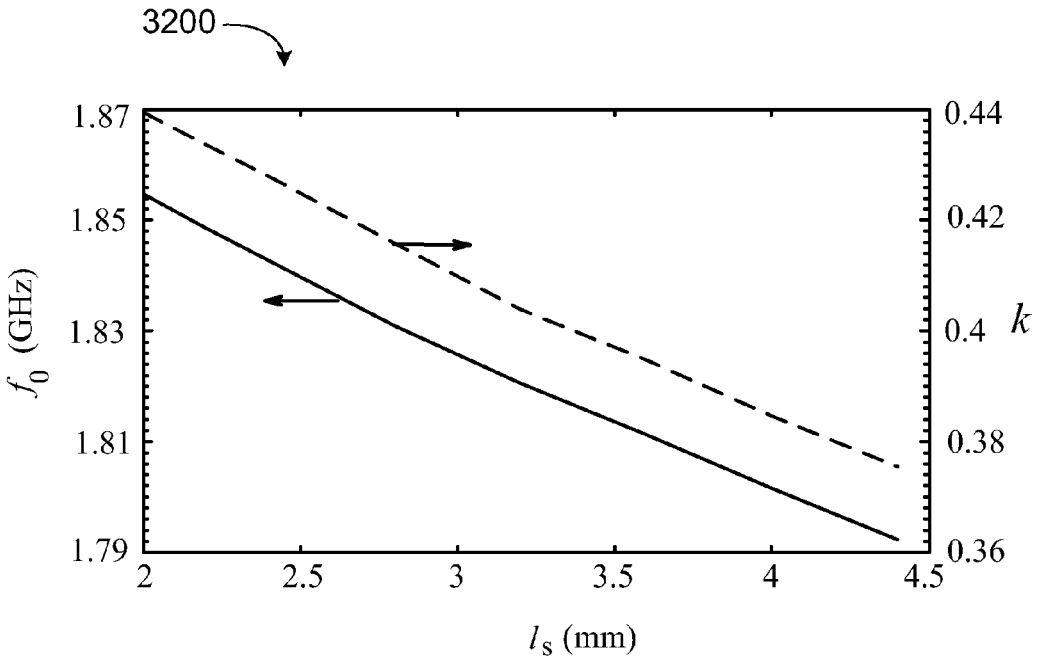

FIG. 32 shows a graph 3200 of the magnetic coupling and resonant frequency versus the length, $l_s$ of the coupling device 2801, as in the example shown in FIG. 28. Again, the solid line is the resonant frequency $f_0$, and the dotted line is the magnetic coupling k.

The coupling and resonant frequency decrease by increasing the length of the coupling device. As $l_s$ increases from 2 mm to 4.4 mm, $f_0$ decreases from 1.855 GHz to 1.792 GHz which represents a 4.2% reduction. k changes from 0.44 to 0.376 which represents a decrease of 6.4%. Increasing $l_s$ is not necessarily equivalent to increasing the spacing between resonators, because it is possible to fit a long, meandered coupling device within a small space between the resonators.

The results in FIG. 30-32 show that, through adjusting the parameters of the coupling device 2801, it is possible to create a broad range of coupling values.

Figure 33:
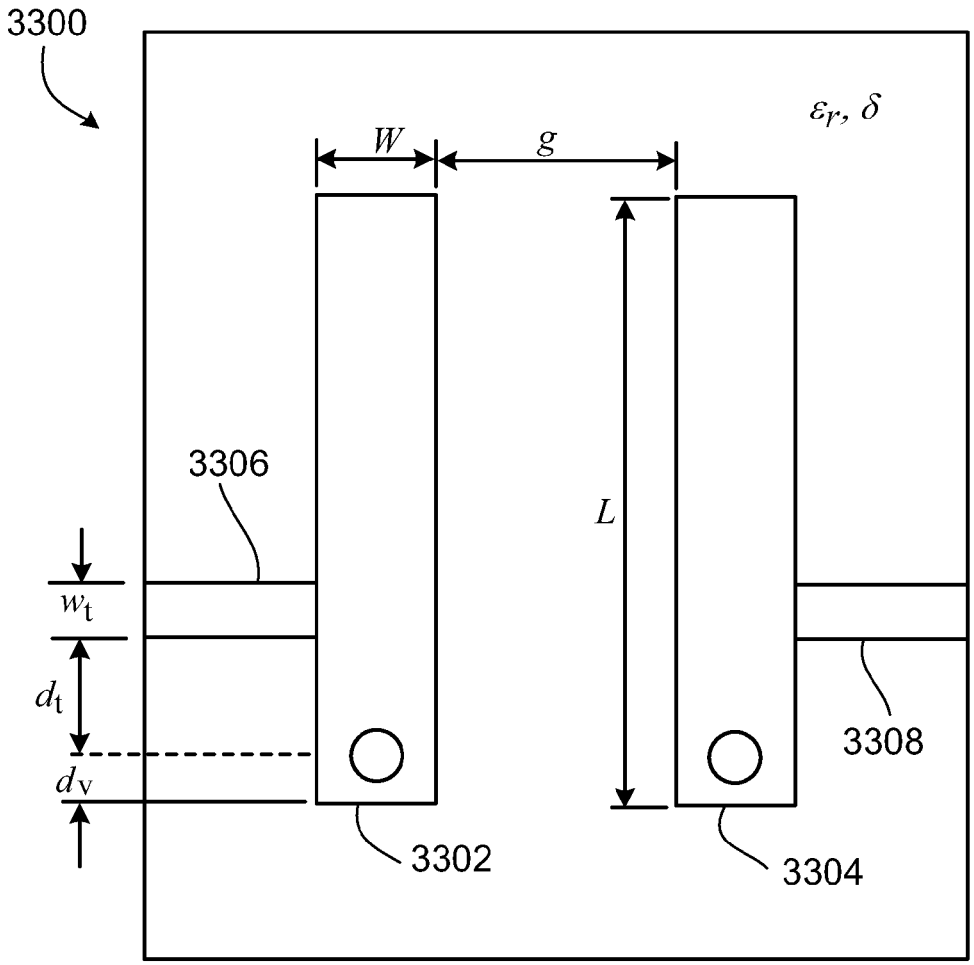
FIG. 33 shows an electronic component that uses gap coupling.

FIG. 33 shows a top view of a combline filter 3300 incorporating a pair of resonators 3302, 3304 coupled using conventional gap coupling, with an input feed line 3306 connected to one resonator 3302 and an output feed line 3308 connected to the other resonator 3304.

FIG. 33 can represent a configuration of a simple two-pole Chebyshev bandpass filter having narrow bandwidth. An exemplary filter is specified with a narrow bandwidth of 4% and center frequency at 1.5 GHz. This bandwidth selection is determined based on the result shown in FIG. 29 where the maximum bandwidth with only two resonators coupled using gap coupling does not exceed 7%. For this example, the coupling values are: $k_{12}$=0.055237 and $R_i=R_0$=0.047446. $k_{12}$ is mutual (inter-resonator) coupling between first and second resonators. $R_i$ and $R_o$ are the input and output coupling, respectively. Additionally, the input/output feed lines are 50-Ω feed lines.

Figure 34:
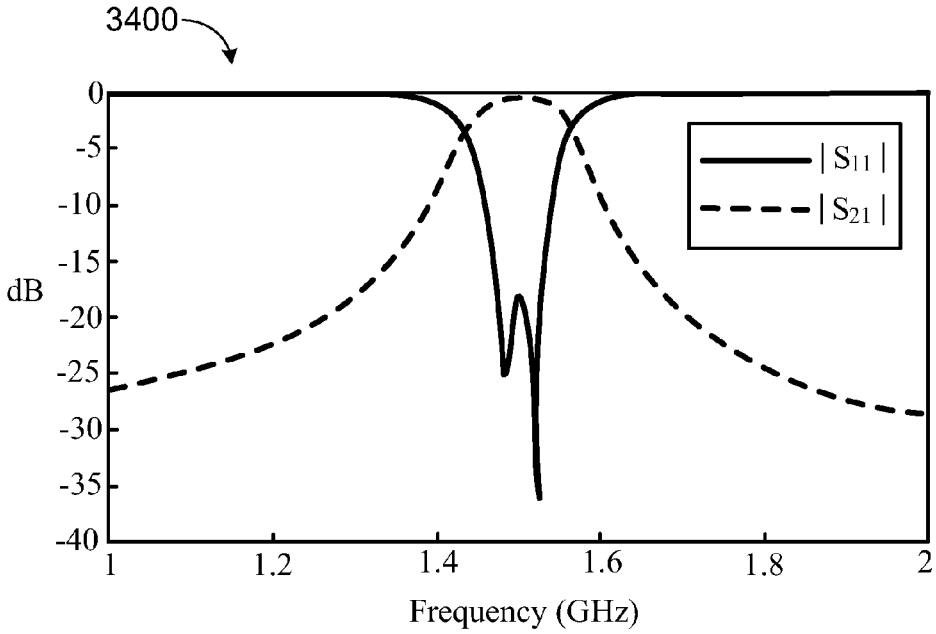
FIGS. 34-35 are graphs of frequency response.

FIG. 34 shows a graph 3400 of the in-band frequency response of the conventional filter 3300 shown in FIG. 33. In this example, the frequency response has the center frequency of 1.5 GHz, an equiripple bandwidth of 60 MHz which corresponds to fractional bandwidth percentage of 4%, a 3-dB bandwidth of 124 MHz (3-dB bandwidth percentage=8.27%), a return loss of 20 dB, and a midband insertion loss of 0.7 dB. The dimensions of the filter are: W=2 mm, L=30 mm, g=2 mm, $r_v$=0.2032 mm (8 mil), $d_v$=0.7032 mm, $d_t$=0.38 mm, $w_t$=3.5 mm, h=1.524 mm (60 mil), $\in_r$=3.55, and tan δ=0.0027.

Figure 35:
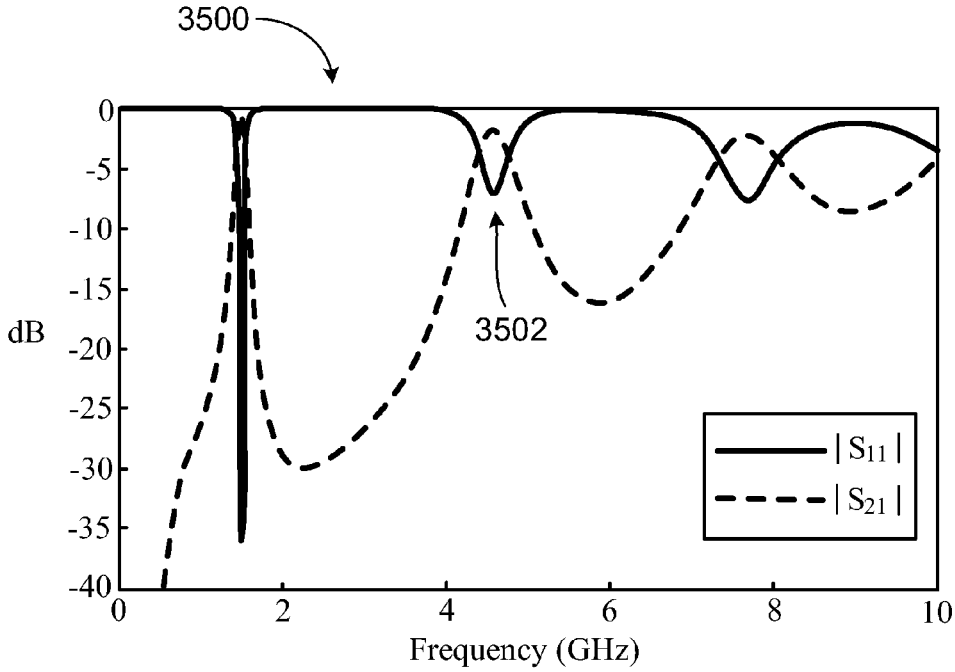

FIG. 35 shows a graph 3500 of the out-of-band frequency response of the filter 3300. In this example, the first spurious response 3502 of the filter 3300 appears at three times the center frequency.

Figure 36:
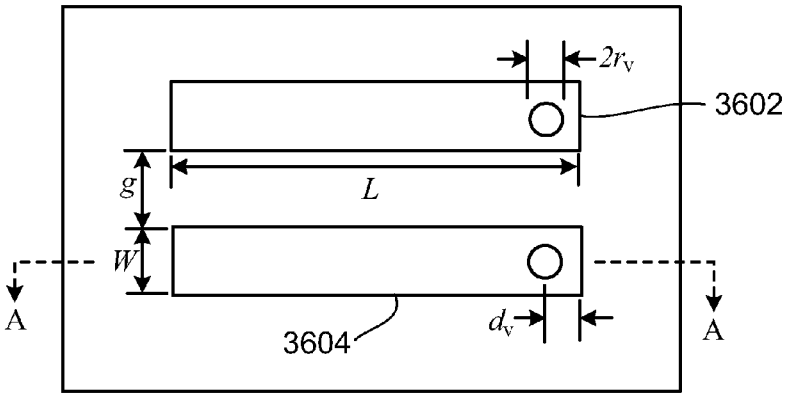
FIGS. 36-37 show a pair of resonators that uses gap coupling.
Figure 37:
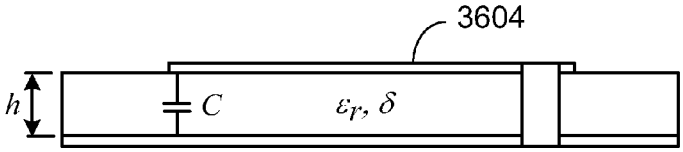

FIG. 36 shows a top view of another example of conventional gap coupling, including a pair of miniaturized planar combline resonators 3602, 3604 loaded with embedded capacitances at the open ends of the resonators. The value of each capacitance C is equal to 11.1 pF. The design parameters of resonators, which provide a resonant frequency of 1.5 GHz, are: W=2 mm, L=9.8 mm, $r_v$=0.2032 mm (8 mil), $d_v$=0.7032 mm, h=0.254 mm (10 mil), $\in_r$=3.55, and tan δ=0.0027. The electrical length of each resonator is approximately 0.10 wavelength of the resonant frequency of the resonator. FIG. 37 shows a side view of one of the planar combline resonators 3604 along cut A-A of FIG. 36.

Figure 38:
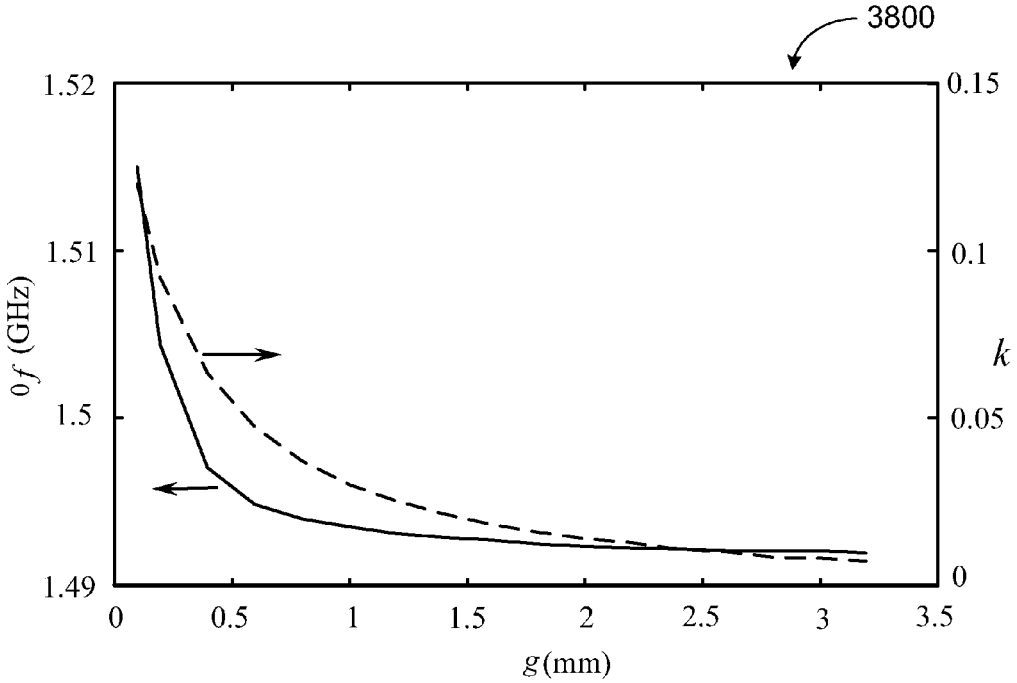
FIG. 38 is a graph of coupling values and resonant frequency.

FIG. 38 shows a graph 3800 of the magnetic coupling and resonant frequency versus the size of the gap, g, using the planar combline resonators 3602, 3604 of FIG. 36. The solid line is the resonant frequency $f_0$, and the dotted line is the magnetic coupling k.

As shown in FIG. 38, there is a decrease of coupling from 0.12 to 0.007 when the gap is increased from 0.1 mm to 3.2 mm. The percentage of coupling reduction is 11.3%. For the same range of g variation, the resonant frequency decreases from 1.515 GHz to 1.492 GHz which corresponds to a 1.53% reduction. In this example, the effect of the gap on the resonant frequency is negligible. When the gap is small the maximum achievable coupling is increased by use of capacitive loading as compared to results for coupled resonators without capacitive loading e.g., as shown in FIG. 29. However, this coupling may not be strong enough for broadband designs. When the gap is larger, the coupling between the resonators is significantly reduced. Further, when the gap is small, the slope of coupling curve is very sharp. This may increase sensitivity to optimization parameters and to fabrication tolerances and precisions.

Also, other examples of the structure in FIG. 36 and FIG. 37, where the miniaturized resonators are loaded with embedded capacitances varying from 4.2 pF to 19.5 pF and each resonator resonates at 1.5 GHz, show similar results for coupling and resonant frequency curves. A small practical gap of size g=0.1 mm has a maximum to coupling of 0.12. This coupling value is very sensitive to changes in gap size g. Thus, the conventional gap coupling method may not be able to provide for large inter-resonator coupling values when the resonators are miniaturized.

Figure 39:
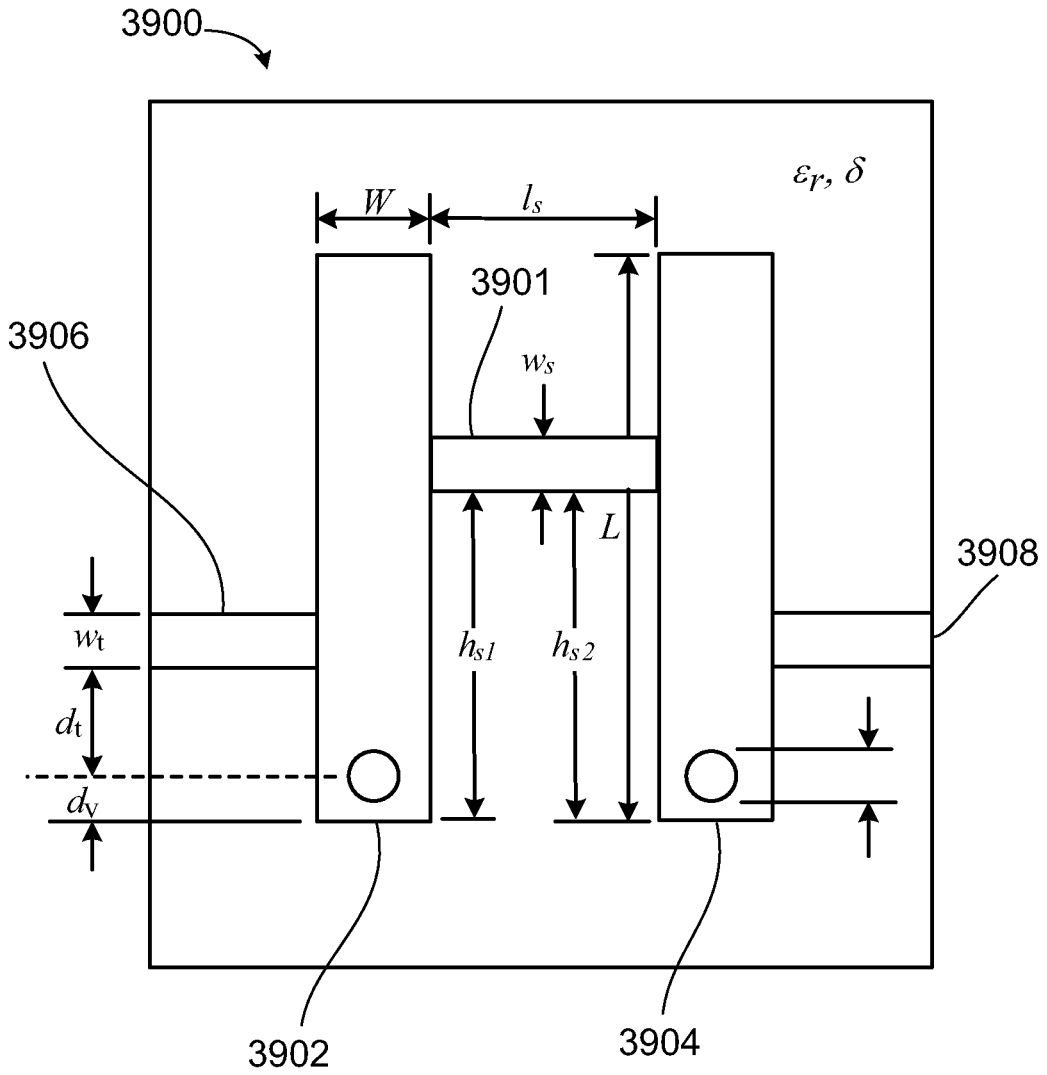
FIG. 39 shows an electronic component that includes a coupling device.

FIG. 39 shows a top view of a two-pole combline filter 3900 having a pair of resonators 3902, 3904 coupled using the coupling device 3901. There is an input feed line 3906 connected to one resonator 3902 and an output feed line 3908 connected to the other resonator 3904. Although this filter 3900 has resonators in a similar configuration to the filter 3300 of FIG. 33 using conventional coupling, the characteristics of this filter 3900 may be different due to the use of the coupling device 3901. In particular, this filter may exhibit larger coupling values between resonators and, therefore a wider passband.

The design parameters of an example of the filter 3900 are: W=2 mm, L=10.24 mm, $r_v$=0.2032 mm (8 mil), $d_v$=0.7032 mm, $d_t$=4.78 mm, $w_t$=0.5 mm, $w_s$=10.24 $l_s$=g=1.4 mm, $h_{s1}$=$h_{s2}$=2 mm, $\in_r$=3.55, and tan δ=0.0027. In this example, the filter 3900 is miniaturized by loading an embedded capacitance of 11.1 pF at the open end of each resonator 3902, 3904. Additionally, the input/output feed lines 3906, 3908 are 50-Ω feed lines. The location of the input/output feed lines 3906, 3908 controls the return loss and the matching of feed lines.

Figure 40:
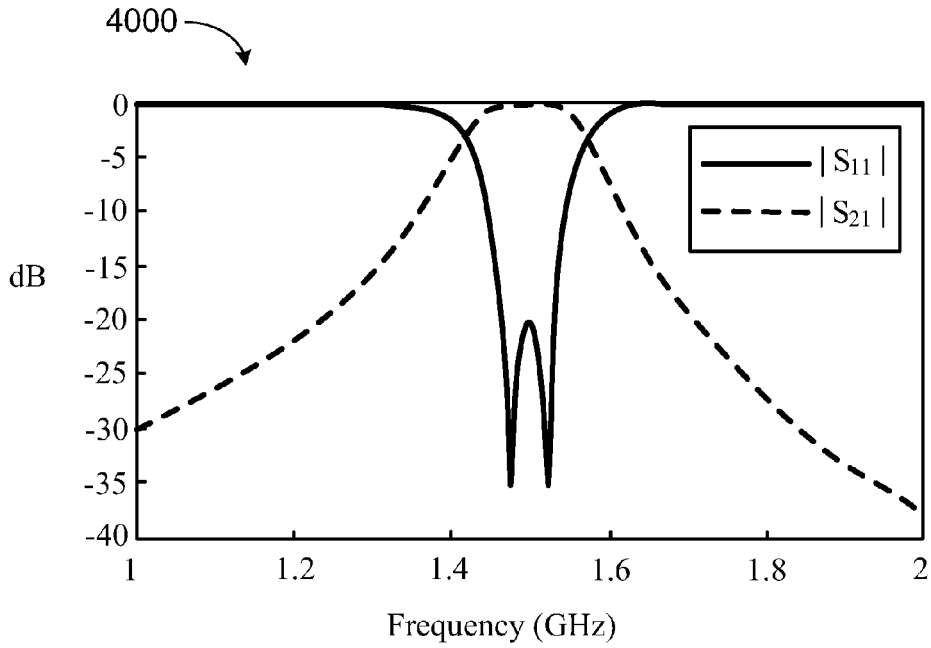
FIGS. 40-43 are graphs of frequency response.

FIG. 40 shows a graph 4000 of the in-band frequency response of the filter 3900. The filter has a center frequency of 1.5 GHz, an equiripple bandwidth of 60 MHz which corresponds to fractional bandwidth percentage of 4%, a 3-dB bandwidth of 156 MHz (3-dB bandwidth percentage=10.4%), a return loss of 20 dB, and a midband insertion loss of 0.4 dB.

Figure 41:
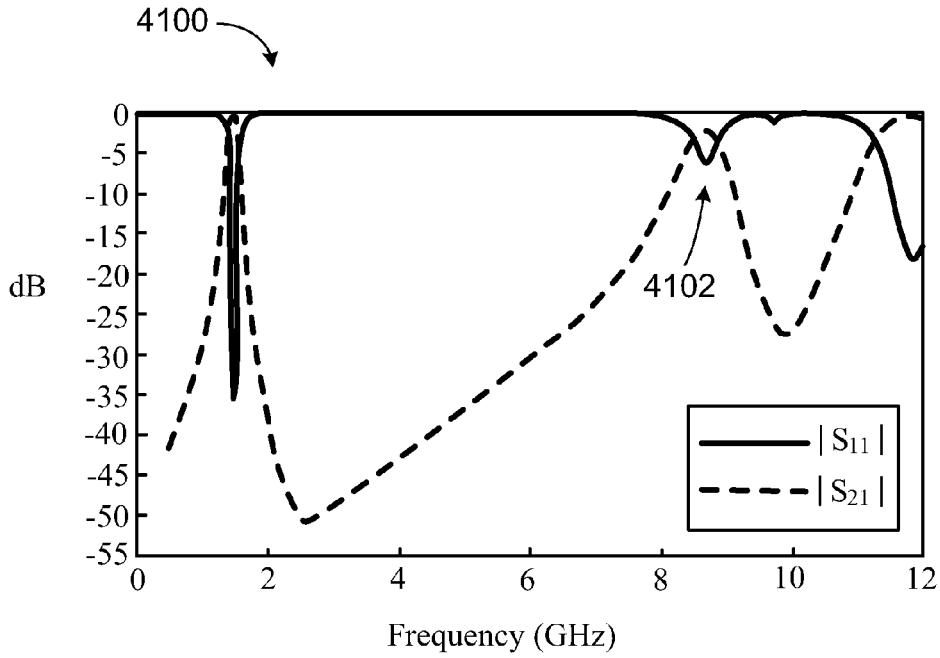

FIG. 41 shows a graph 4100 of the out-of-band frequency response of the filter 3900. In this example, the first spurious response 4102 appears at six times the filter center frequency because the resonator electrical length has been shortened by the use of loading capacitance. As compared to the response of the conventional filter shown in FIG. 35, the spurious response is pushed away and losses are reduced. The electrically miniaturized resonators may show a wider stopband clear of spurious response similar to this example.

Figure 42:
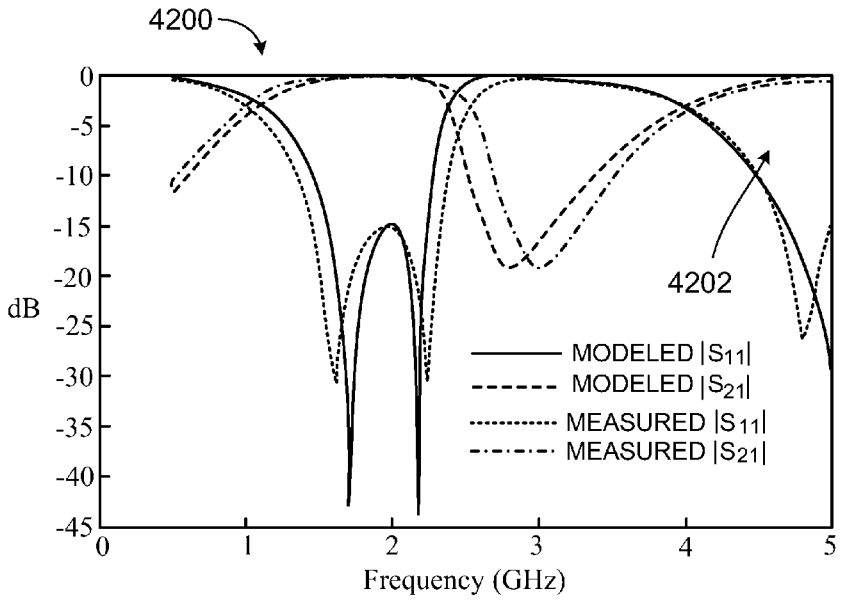

FIG. 42 shows a graph 4200 of modeled (simulated) and measured frequency responses of another example of the two-pole combline filter 3900 of FIG. 39. The design parameters of this filter are: W=2 mm, L=30 mm, $r_v$=0.2032 mm (8 mil), $d_v$=0.7032 mm, $w_s$=1 mm, $l_s$=g=2 mm, $h_{s1}$=$h_{s2}$=10 mm, $w_t$=3.5 mm, h=1.524 mm (60 mil), $\in_r$=3.55, and tan δ=0.0027. In this example, $d_t$ is 11 mm, and the filter response has a center frequency of 1.861 GHz, a 3-dB bandwidth of 1268 MHz (3-dB bandwidth percentage=68%), an equiripple bandwidth of 680 MHz which corresponds to fractional bandwidth percentage of 36.5%, a midband insertion loss of 0.16 dB, and a return loss of 15 dB. The first spurious response 4202 is at about 4.5 GHz.

Figure 43:
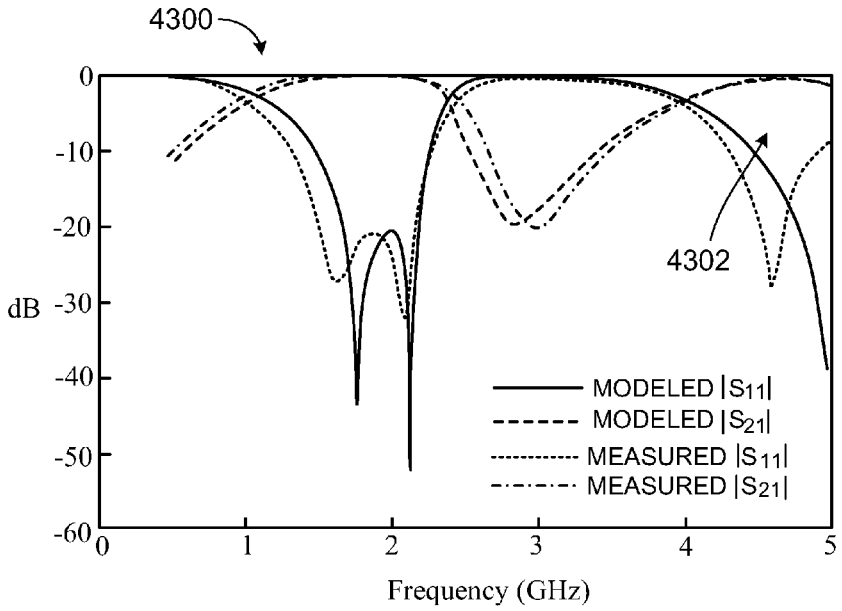

FIG. 43 shows a graph 4300 of further modeled and measured frequency responses of another example of the two-pole combline filter 3900 of FIG. 39. The design parameters of this filter are similar to those described for FIG. 42.

In this example $d_t$ is increased to 11.4 mm, and the filter response has a center frequency of 1.887 GHz, a 3-dB bandwidth of 1278 MHz (3-dB bandwidth percentage=68%), an equiripple bandwidth of 498 MHz which corresponds to fractional bandwidth percentage of 26%, a midband insertion loss of 0.1 dB, and a return loss=20 dB. The first spurious response 4302 is at about 4.5 GHz.

Thus, in the frequency responses of filter shown in FIG. 42 and FIG. 43, the bandwidth of filter examples designed using the coupling device is eight times the bandwidth of filter designed using conventional gap coupling and its frequency response shown in FIG. 34. This means that in these filter examples the coupling device provided stronger coupling between two resonators. In general, the coupling device can easily realize any required inter-resonator coupling strength. Further, in conventional designs, the minimum number of filter resonators (filter order) may be determined according to various design specifications including bandwidth, in-band insertion loss, out-of-band selectivity, and feasibility of creating the required coupling values. If the coupling between resonators cannot be achieved using conventional gap coupling, designer may increase the filter order, reshape/engineer/change resonator structures, or does both changes. However, the coupling device can be used to control the characteristics of a filter without necessarily increasing the number of resonators or changing and reshaping the resonators.

Also, the first spurious responses of filters 3900 as shown in FIG. 42 and FIG. 43 appear at 4.5 GHz which is about 2.3 times the filter center frequency. This is similar to the frequency location obtained for the first spurious response of the conventional filter 3300 as shown in FIG. 35 because the spurious response location in these configurations is related to the electrical length of each individual resonator. Further, for a wideband filter like the filter 3900 that uses the coupling device, the passband extends almost from the resonant frequency of each individual resonator up to higher frequencies.

In other words, the resonance of an individual resonator is close to the lower edge of the passband and the first spurious response of the wideband filter is close to the upper edge of the passband. Therefore, spurious response may destroy the selectivity of filter response.

For those cases that the electrical length of resonator establishes the next resonance in the structure, it is possible to push further away higher-order resonances from the operating band of filter by reducing the electrical length of the resonator. Thus, an optimized design of electrically miniaturized resonators can provide a wider stopband clear of spurious responses. Therefore, electromagnetic interference created by spurious responses can be suppressed wherever a wide stopband is desirable.

The structure of a resonator according to available fabrication technology and available materials may be engineered for different purposes such as reducing the resonator size or providing the required value of inter-resonator coupling. Reducing the electrical size of resonators is important in the design of miniaturized electrical components. Furthermore, it may push away the spurious response from the operating bandwidth of the electrical component.

For example, combline or interdigital resonator is modeled as a shunt resonant configuration. These types of resonators may be miniaturized by imitating the design method used for metamaterial or electromagnetic bandgap (EBG) structures. One example of a unit cell of metamaterial structure which may be appropriate to be adapted for design of combline or interdigital resonator is a composite right-handed or left-handed (CRLH) metamaterial unit cell. A CRLH metamaterial unit cell can have a mushroom configuration. EBG structure which contains mushroom configuration is another example that can be used to produce a shunt resonance for the design of combline or interdigital resonator.

The resonators are engineered for the design of electrical component and the coupling device is used to create coupling. In this case, the electrical component is not a metamaterial transmission line (the electrical component is not operating in a left-handed mode).

Figure 44:
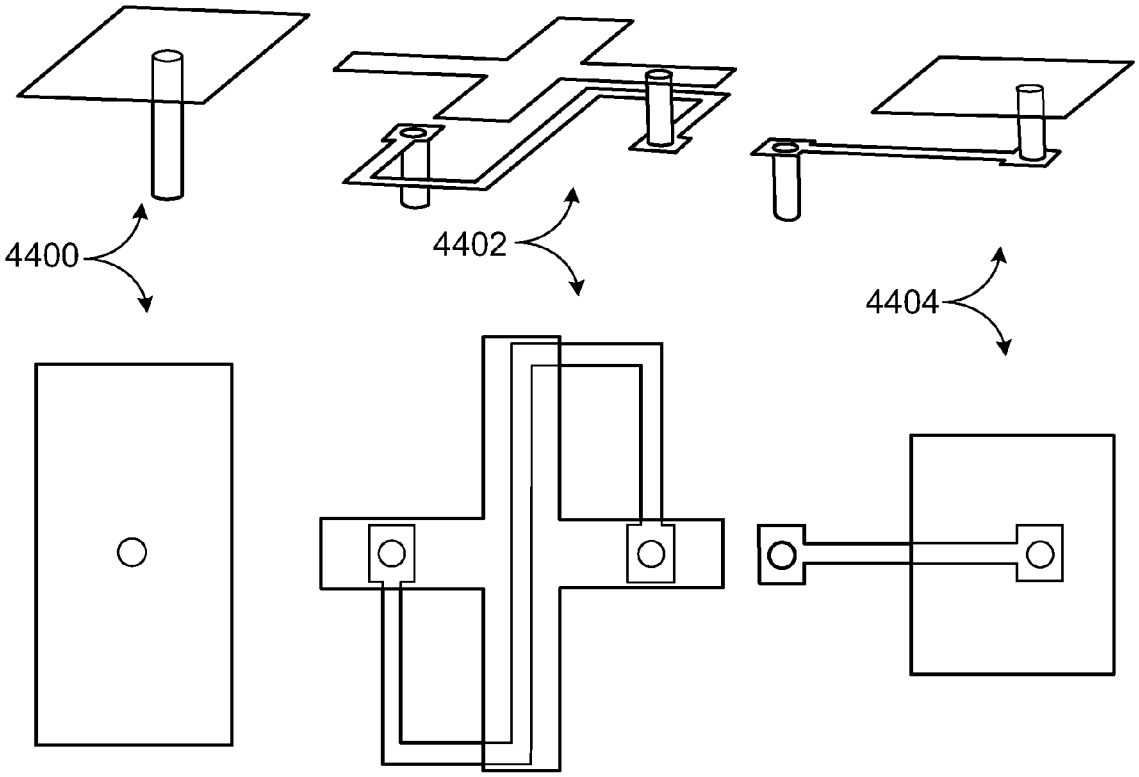
FIG. 44 shows configurations of mushroom structures.

FIG. 44 shows examples of possible configurations 4400, 4402, 4404 of a mushroom structure. One configuration 4400 is made of a via and a patch. Another configuration 4402 is made of two vias, a meandered strip, and a patch. Another configuration 4404 is made of two vias, a straight strip, and a patch. For comparison, another example of a mushroom structure is the miniaturized engineered cavity combline resonator mushroom structure 2002 shown in FIG. 20.

A mushroom structure can be composed of two parts. The first part can be a combination of vias, straight strips, spiral strips, or meandered strips. This part can vertically cross dielectric layers as shown in examples of FIG. 44. The second part can be a patch of arbitrary shape as shown in examples of FIG. 44. In some implementations such as combline or interdigital, one end of the first part can be attached to the second part while its other end is grounded as shown in cavity combline resonator in FIG. 20.

This type of engineered structure can be implemented using a multilayer technology such as PCB or LTCC based on microwave laminates. The lower losses and higher permittivity of laminates may reduce the insertion loss and the dimensions of designed components.

Electrical components which include coupled engineered resonators can have various arrangements, including, for example, a straight line, folded path, or random alignment. The configuration of engineered resonators in an electrical component can also be different. For instance, electrical components include coupled engineered combline or interdigital resonators designed using mushroom structures can have any one of several configurations, some of which are described as follows. In one example, the engineered resonators have identical mushroom structures and dimensions, and they are arranged to form combline pattern. In another example, the engineered resonators have different mushroom structures and they are arranged to create combline pattern. In this example, only one mushroom structure may have a different configuration than the others or every mushroom structure may have a different configuration than the others. In another example, the engineered resonators have identical mushroom structure but different dimensions. In this example, these resonant units are arranged to create combline pattern. Further, one mushroom structure may have different dimensions than the others or every mushroom structure may have different dimensions than the others. In another example, the engineered resonators have identical mushroom structure and dimensions but alternating orientation to form an interdigital pattern. In another example, the engineered resonators have different mushroom structures and alternating orientation to create an interdigital pattern. In this example, one mushroom structure may have a different configuration than the others or every mushroom structure may have a different configuration than the others. In another example, the engineered resonators have an identical structure configuration but different dimensions. In this example, the mushroom structures alternate in orientation to create an interdigital pattern. Further, in this example, one mushroom structure may have different dimensions than the others or every mushroom structure may have different dimensions than the others. In another example, the engineered resonators have identical mushroom structures and dimensions and they are arranged in different orientations to create a mixture of combline and interdigital patterns. In another example, the engineered resonators have different mushroom structures and different orientations to create a mixture of combline and interdigital patterns. In this example, one mushroom structure may have a different configuration than the others or every mushroom structure may have a different configuration than the others. In another example, the engineered resonators have identical structure configurations, different dimensions, and different orientations to create a mixture of combline and interdigital patterns. In this arrangement, one mushroom structure may have different dimensions than the others or every mushroom structure may have different dimensions than the others.

A CRLH metamaterial unit cell consists of shunt and serial resonators. This type of structure is electrically and physically miniaturized. Under certain condition unit cell of this structure can be adapted for some configuration of resonators. For example, the CRLH unit cell can be physically changed to provide mainly the required shunt resonance and it can be used as combline or interdigital configuration.

Figure 45:
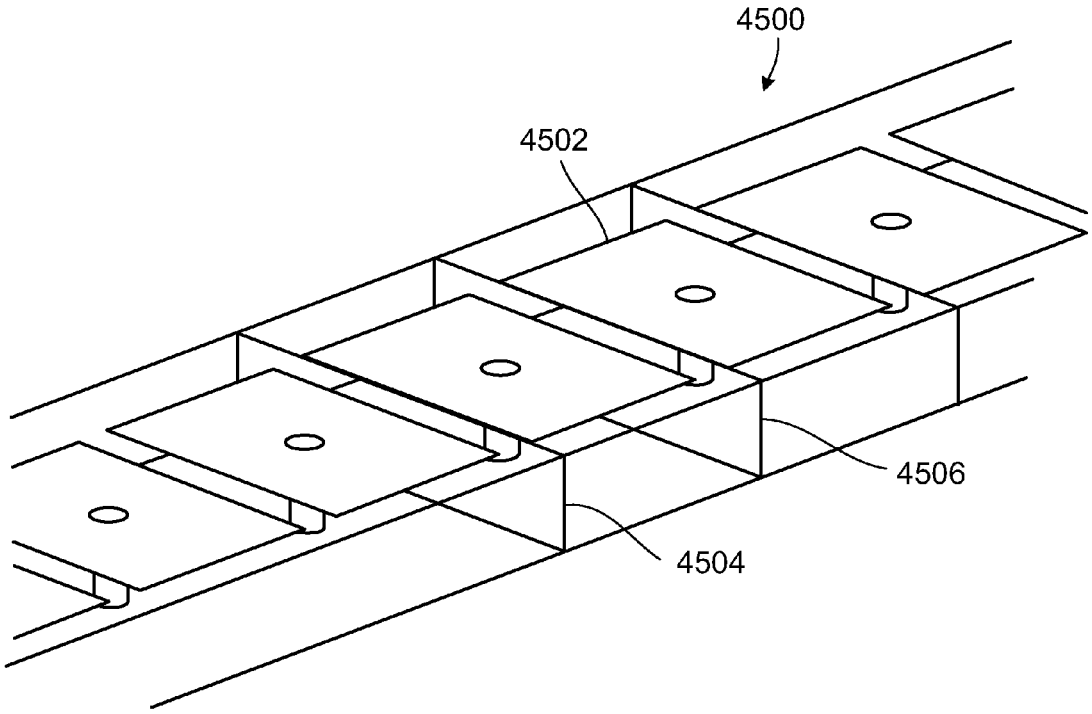
FIG. 45 shows a metamaterial transmission line.

FIG. 45 shows a three-dimensional view of an example of metamaterial transmission line 4500 having CRLH unit cells 4502 in the form of mushroom structures embedded in waveguide. To adapt this CRLH unit cell for design of a cavity combline resonator, each CRLH unit cell 4502 is shorted from both ends to define boundaries 4504, 4506 of a resonant cavity. Here, the CRLH unit cell 4502 is a repeated part of either an open or a shielded metamaterial transmission line.

The metamaterial or EBG transmission line including mushroom structures can have different configurations. A unit cell of an open transmission line includes a mushroom shorted to the ground plane through a via. A mushroom structure positioned between a parallel-plates waveguide can also be considered a unit cell of an open transmission line because it radiates energy out from the opened sides. When multilayer technology is used, the parallel plates of a waveguide can be metallic solid planes between which dielectric layers are inserted. The mushroom structure can be shorted to one of the grounded plates through a via.

A unit cell of a shielded transmission line includes a mushroom structure confined inside a closed waveguide. When multilayer technology is used, the top and bottom walls of this waveguide are metallic solid planes between which dielectric layers are placed, and the side walls consist of closely-spaced vias stitching the top wall to the bottom wall to minimize energy radiation at the operating frequency of the component. The mushroom structure is grounded to the top or bottom wall of waveguide through a via.

If a unit cell of a shielded transmission line is shorted from both ends along the longitudinal direction of wave propagation then an engineered resonant cavity is created which is isolated from the surrounding media such as the engineered resonator shown in FIG. 45. An iris window can be opened in the common wall between cavities, the wall between input cavity and input feedline, and the wall between output cavity and output feedline to be used for coupling as shown in filter 2000 in FIG. 20.

Figure 46:
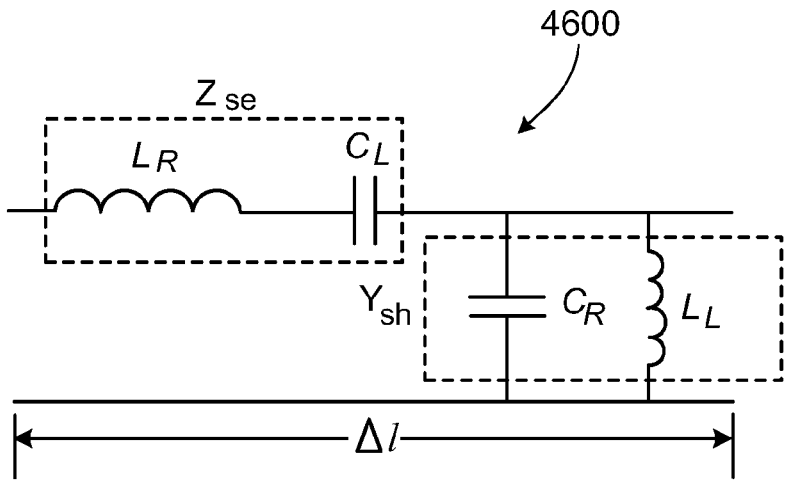
FIG. 46 shows a circuit model of a unit cell of composite left-handed right-handed metamaterial.

FIG. 46 shows an asymmetric equivalent circuit 4600 for a unit cell of a lossless CRLH metamaterial transmission line 4500, which is modeled as an infinite array of unit cells. The circuit 4600 includes series impedance ($Z_{se}$) and shunt admittance ($Y_{sh}$). This model consists of series and shunt resonators. Appropriate changes on this unit cell remove serial resonance (or push the resonance out of frequency band of interest). This modified unit cell can be used for the design of combline or interdigital resonators.

Figure 47:
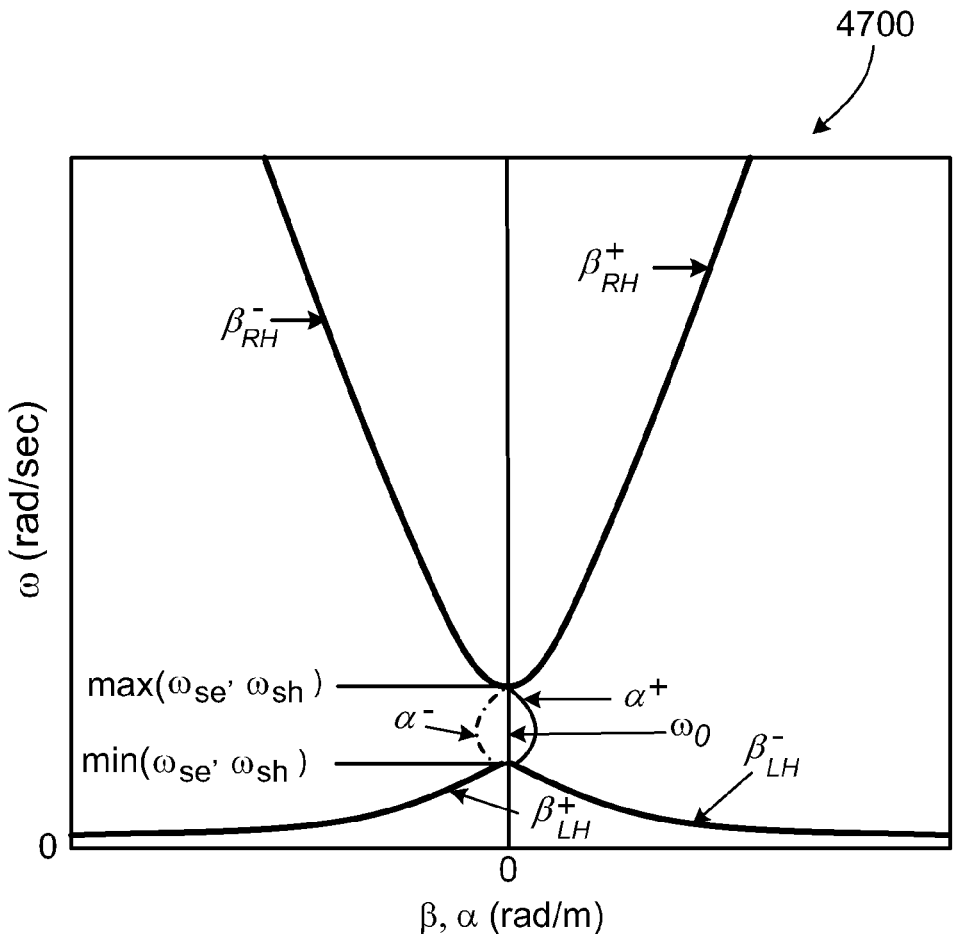
FIG. 47 is a dispersion and attenuation diagram of the metamaterial unit cell.

FIG. 47 shows a corresponding dispersion and attenuation diagram 4700 for the circuit 4600. The graph illustrates the different types of wave propagation, including left handed (LH), right handed (RH), and stopband (bandgap). The first propagating mode of the CRLH transmission line 4500 is LH. The second mode is RH. A bandgap may exist between the first and second modes. This bandgap is delimited by a shunt resonance ($f_{sh}$) and a series resonance ($f_{se}$). The cutoff frequency for LH and RH modes is determined by resonance of corresponding LH and RH elements.

The metamaterial unit cell 4502 is configured such that $f_{sh}$ can be equal to the unloaded resonant frequency $F_0$ of a single resonator. $f_{se}$ can be much higher than $f_{sh}$ in order to push the second mode outside of the operating bandwidth. This provides for a wide stopband free from the spurious effects of higher order modes.

The first part of a mushroom structure can replace the rod or strip of a conventional combline or interdigital structure. This part contributes primarily to the LH shunt inductance $L_L$ shown in FIG. 46. The second part of the mushroom structure can provide for a parallel plate capacitance between the patch and existing ground planes. This capacitance corresponds to the RH shunt capacitance $C_R$ shown in FIG. 46, and it replaces the capacitive loading at the open end of rod or strip in a combline/interdigital structure. In the CRLH metamaterial transmission line shown in FIG. 45, the coupling capacitance between patches of adjacent mushrooms is modeled as the LH series capacitance $C_L$ shown in FIG. 46. The RH series inductance $L_R$ results from the patch inductance.

Figure 48:
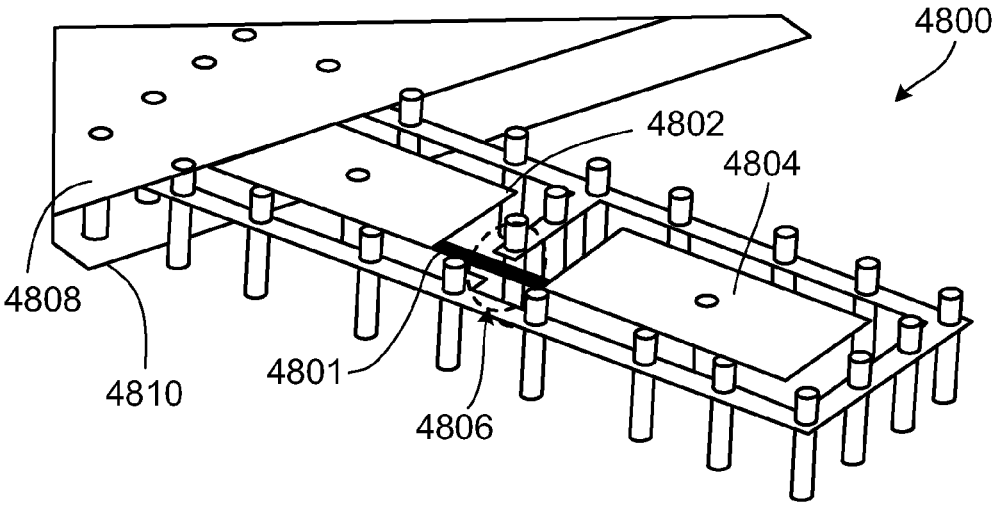
FIG. 48 shows a three-dimensional view of mushroom structure cavity combline resonators coupled with a coupling device.

FIG. 48 shows a three-dimensional view 4800 of resonators in the form of mushroom structures 4802, 4804, coupled using the coupling device 4801. In this example, the coupling device 4801 traverses an inductive iris 4806 and it connects the mushroom structures 4802, 4804 to each other. The coupling device 4801 inductively couples two engineered cavity combline resonators. The cavity is bounded by a top cavity wall 4808 and a bottom cavity wall 4810.

Figure 49:
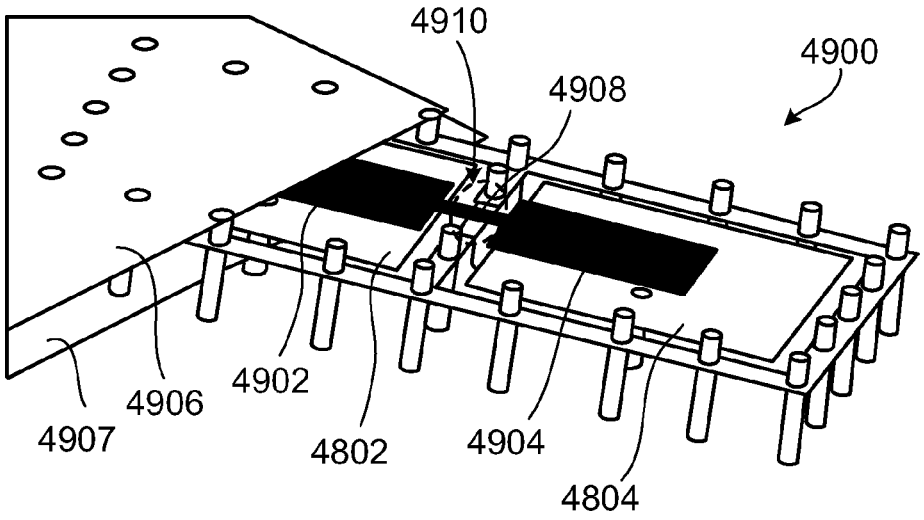
FIG. 49 shows a three-dimensional view of mushroom structure cavity combline resonators coupled with probe coupling.

FIG. 49 shows a three-dimensional view 4900 similar to the view 4800 of FIG. 48, but the mushroom structures 4802 and 4804 are capacitively coupled. Here, the coupling device consists of additional capacitive coupling patches 4902, 4904 and a transmission line 4908 (sometimes referred to as a probe) to connect these patches. The transmission line 4908 traverses a capacitive iris 4910. In FIG. 49, the transmission line 4908 provides capacitive coupling while in FIG. 48 the coupling device 4801 provides inductive coupling. The coupling device 4801 providing inductive coupling directly connects to resonators as shown in FIG. 48. The capacitive coupling in some configurations such as combline may be used for cross coupling (coupling between non adjacent resonators) to improve the selectivity of frequency response.

In the example of FIG. 49, the capacitive coupling patches 4902, 4904 are placed in each cavity at the location of maximum electric field between each mushroom structure 4802, 4804 and the top cavity wall 4906. The cavity is also bounded by a bottom cavity wall 4907. The probe 4908 which is attached to these patches couples two mushroom resonators 4802, 4804 through an electric field. Each capacitive coupling patch provides for a combination of two parallel-plate capacitances. The first capacitance is between the patch and its associated mushroom structure. The second capacitance is between the patch and the grounded cavity top wall 4906.

The original thickness of dielectric between the mushroom patch and the cavity top wall may be constant. However, the inclusion of the capacitive coupling patches 4902, 4904 divides this dielectric to two parts. Thus, a high-permittivity dielectric material may fit between the mushroom structures 4802, 4804 and the patches to increase the capacitance value. The capacitive coupling may be controlled by the values of added capacitances as well as the dimensions and location of the transmission line 4908.

Field distributions for examples of miniaturized engineered cavity resonators made of mushroom structures inside cavities are shown in FIGS. 50-55. The knowledge of field distribution inside the resonators can be helpful for adjusting the coupling. The capacitive coupling is in direct connection with electric field and the inductive coupling is related to magnetic field.

Figure 50:
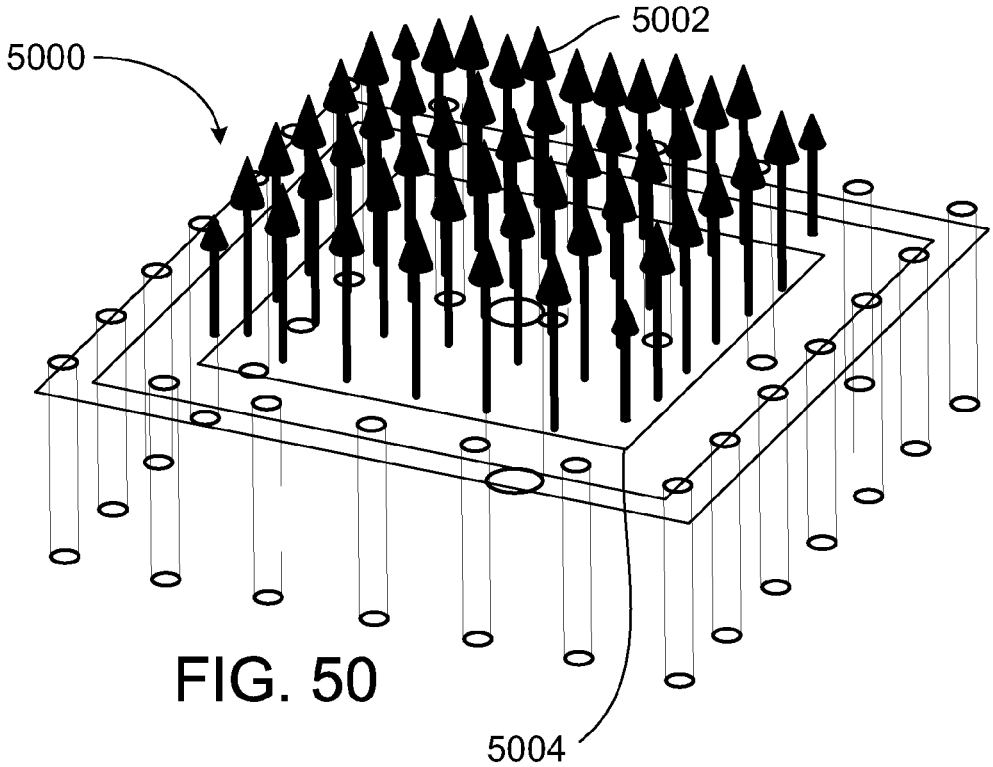
FIGS. 50-55 show field distributions for mushroom structure cavity combline resonators
Figure 51:
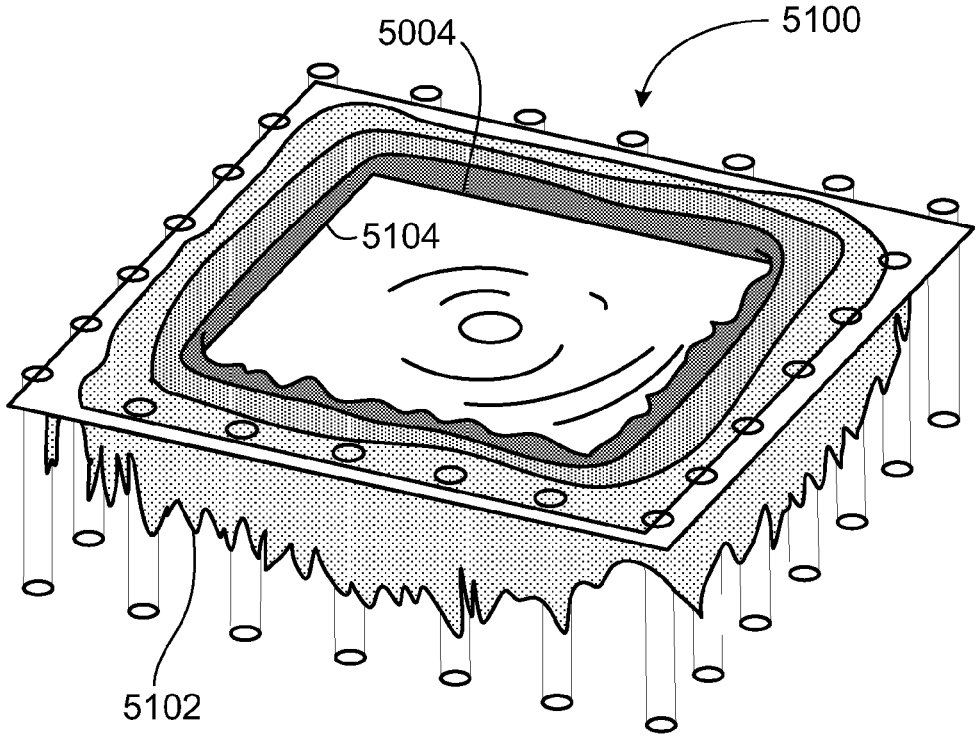
Figure 52:
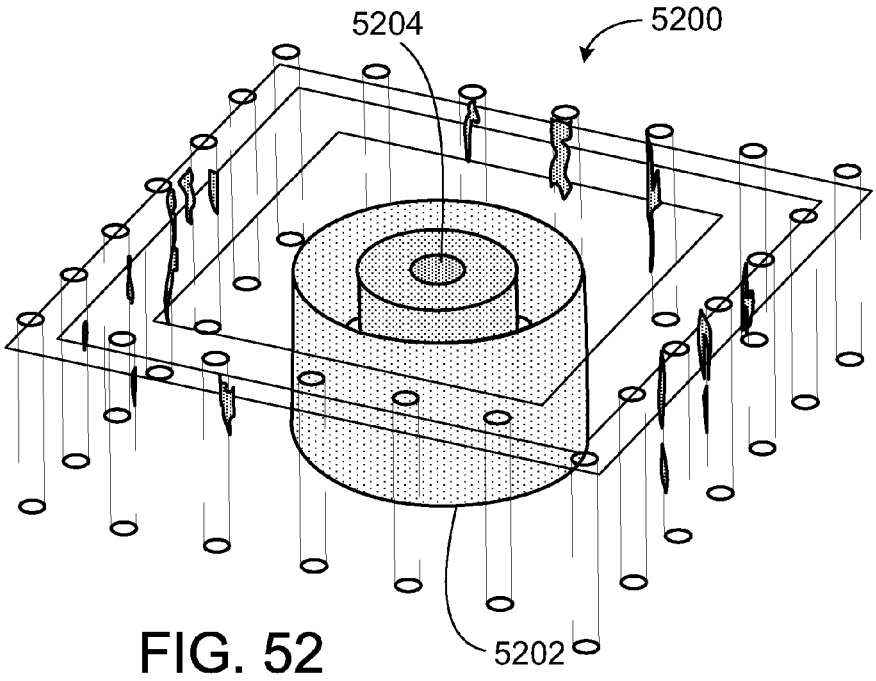

In these examples, the mushroom structure 5004 is made of a via and a square patch. (Refer to FIGS. 20, 44, 48, and 49 for other examples of mushroom structures similar to the ones shown here.) Distributions of the electric field inside the cavity resonator in vector form 5000 and magnitude form 5100 are shown in FIG. 50 and FIG. 51, respectively. In FIG. 51, the darker regions indicate a stronger field, and the lighter regions indicate a weaker field. The distribution shows that the electric field 5002, 5102 is very strong at the location 5104 between the patch of mushroom structure 5004 and the cavity top wall (not shown) and does not have strong components in other locations or directions. The distribution 5200 of the magnetic field 5202 inside the cavity resonator is shown in FIG. 52. The magnetic field 5202 mainly surrounds the mushroom via 5204 and tapers off in strength beyond that point.

Figure 53:
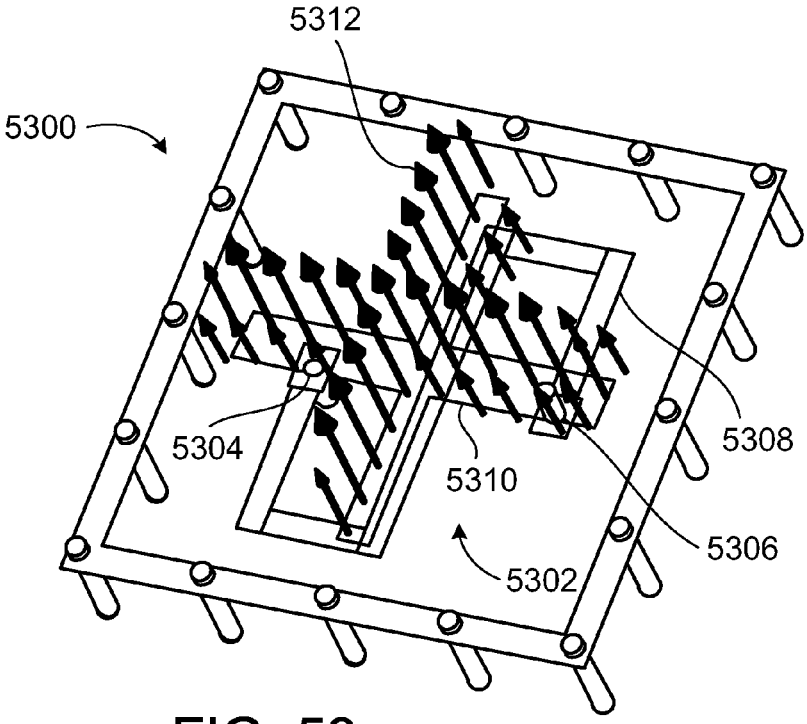
Figure 54:
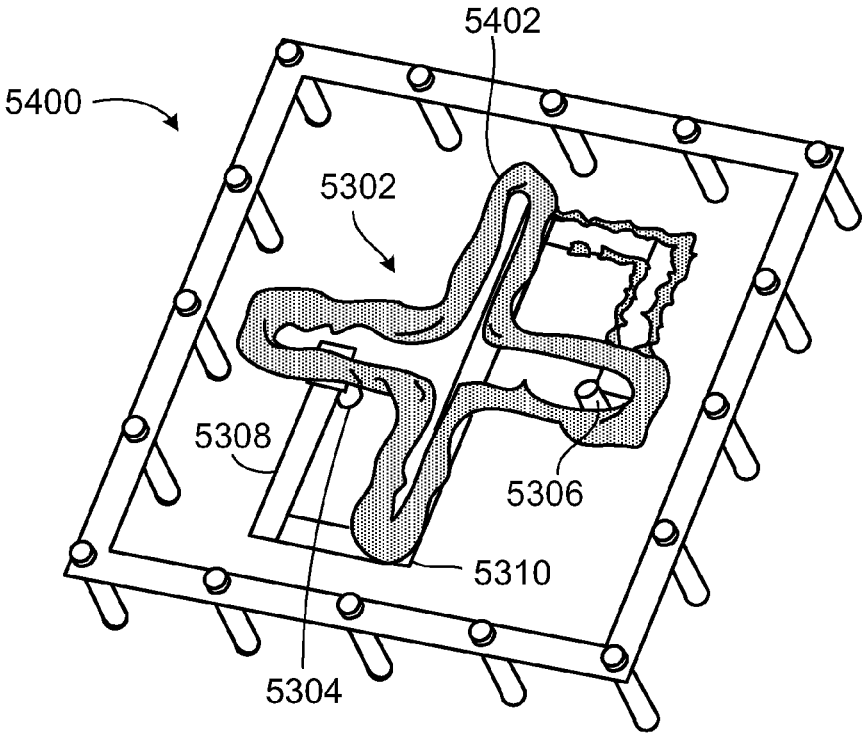
Figure 55:
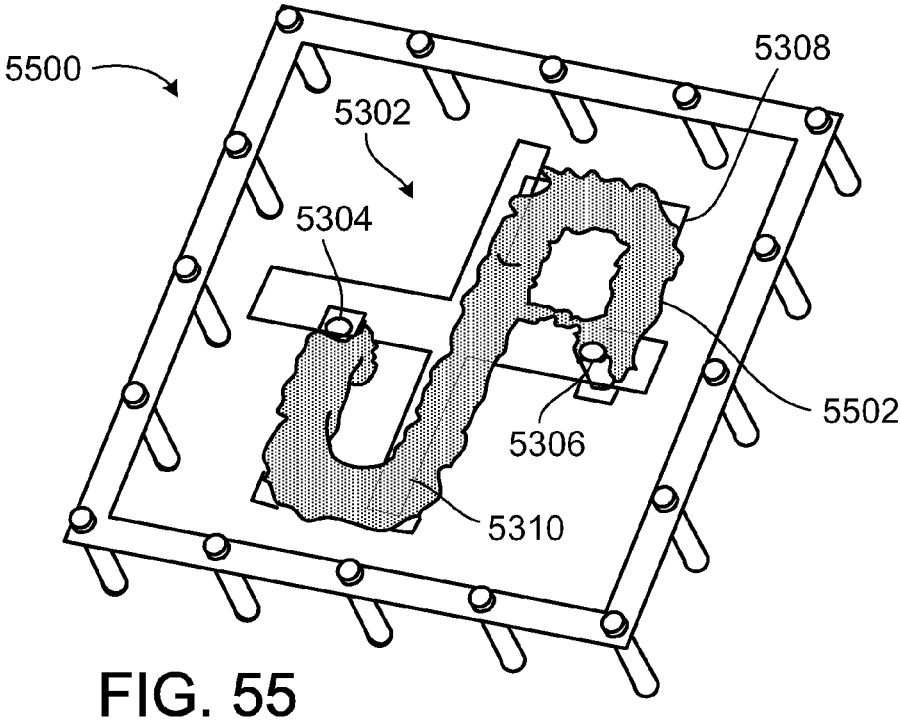

In the next example, the mushroom structure 5302 is made of two vias 5304, 5306, one turn of meandered strip 5308, and a cross patch 5310. Distributions of the electric field inside the cavity resonator in vector form 5300 and magnitude form 5400 are shown in FIG. 53 and FIG. 54, respectively. The distribution shows that the electric field 5312, 5402 is very strong between the mushroom patch 5310 and the cavity top wall (not shown) and weak in other directions and locations. The distribution 5500 of the magnetic field 5502 inside the cavity resonator is shown in FIG. 55. The magnetic field 5502 mainly surrounds the mushroom vias 5304, 5306 and meandered strip 5308.

A number of implementations have been described. Nevertheless, it will be understood that various modifications may be made without departing from the spirit and scope of the following claims. For example, the techniques described herein can be performed in a different order and still achieve desirable results.

It is to be understood that the foregoing description is intended to illustrate and not to limit the scope of the invention, which is defined by the scope of the appended claims. Other embodiments are within the scope of the following claims.

What is claimed is:

1. A circuit comprising:

a first and a second electromagnetic resonator, each configured to operate in a transverse electromagnetic mode, the first electromagnetic resonator being operable at a first resonant frequency and the second electromagnetic resonator being operable at a second resonant frequency; and a coupling device configured to operate in the transverse electromagnetic mode, wherein the coupling device is directly connected to the first electromagnetic resonator at a first connection point and directly connected to the second electromagnetic resonator at a second connection point, and the coupling device inductively couples the first and second electromagnetic resonators and provides a coupling value of at least 0.12, wherein the coupling device is entirely electrically conductive, and wherein each of the first and second connection points is at a non-zero potential.

2. The circuit of claim 1, wherein the first and second resonators are planar folded-line resonators and are interleaved.

3. The circuit of claim 1, wherein the first resonator is a cavity resonator.

4. The circuit of claim 1, wherein the first resonator is a planar resonator.

5. The circuit of claim 1, wherein the coupling device is inserted through an opening in a wall shared by the first and second electromagnetic resonators.

6. The circuit of claim 1, wherein the first electromagnetic resonator is a single-mode resonator.

7. The circuit of claim 1, wherein the first electromagnetic resonator is a multi-mode resonator.

8. The circuit of claim 1, wherein the first electromagnetic resonator and the second electromagnetic resonator are one of a combline configuration, a folded-line configuration, and an interdigital configuration.

9. The circuit of claim 1, wherein the first electromagnetic resonator operates in a different mode than the second electromagnetic resonator.

10. The circuit of claim 1, wherein a configuration of the first electromagnetic resonator is different from a configuration of the second electromagnetic resonator.

11. The circuit of claim 1, wherein the coupling device is configured to convey a signal from the first resonator to the second resonator.

12. The circuit of claim 11, wherein the coupling device is configured to convey the signal across a magnetic field.

13. The circuit of claim 12, wherein the magnetic field is dominant in strength relative to an electric field.

14. The circuit of claim 1, wherein the coupling device includes a conductive transmission line.

15. The circuit of claim 1, wherein the coupling device includes a metallic material.

16. The circuit of claim 1, wherein the coupling device includes a strip.

17. The circuit of claim 16, wherein the geometry of the strip includes one of a straight shape, meandering shape, a fractal shape, and a spiral shape.

18. The circuit of claim 1, wherein the coupling device includes a bar.

19. The circuit of claim 1, wherein the coupling device includes a rod.

20. The circuit of claim 1, wherein the coupling device includes a cylindrical structure.

21. The circuit of claim 1, wherein the first electromagnetic resonator is configured to operate in a range of radio frequencies.

22. The circuit of claim 1, wherein the first electromagnetic resonator is configured to operate in the range of microwave frequencies.

23. The circuit of claim 1, wherein the first and second electromagnetic resonators are synchronously tuned.

24. The circuit of claim 1, wherein the first and second electromagnetic resonators are asynchronously tuned.

25. The circuit of claim 1, wherein the first resonator is tuned in at least one of an electrical, mechanical, or magnetic manner.

26. The circuit of claim 1, wherein the first and second resonators form a portion of an active component.

27. The circuit of claim 1, wherein the first and second resonators form a portion of a passive component.

28. The circuit of claim 1, wherein the first and second resonators form a portion of a symmetric component.

29. The circuit of claim 1, wherein the first and second resonators form a portion of an asymmetric component.

30. The circuit of claim 1, wherein the first electromagnetic resonator and the coupling device are formed in a substrate.

31. The circuit of claim 1, wherein the first electromagnetic resonator, the second electromagnetic resonator and the coupling device are formed in a substrate.

32. The circuit of claim 1, wherein the first electromagnetic resonator has a length of less than one quarter of its resonant frequency wavelength.

33. The circuit of claim 1, wherein the coupling device has a dimension of at least 1 millimeter.

34. The circuit of claim 1, wherein the coupling device is representable as an inductance having a nano-henry (nH) value.

35. The circuit of claim 1, wherein the first and second resonators are slow-mode resonators comprising fractal resonators, circular-ring resonators, rectangular-ring resonators, or split-ring resonators.

36. The circuit of claim 1, wherein the first resonator or the second resonator has a length that is a fraction of a wavelength at the first resonant frequency or the second resonant frequency of the first or second resonator.

37. The circuit of claim 1, wherein the first resonator or the second resonator has a length that is times of a wavelength at the first resonant frequency or the second resonant frequency of the first or second resonator.

38. An apparatus comprising:

a planar frequency filter formed in a dielectric substrate, and having a first and a second planar resonator, each configured to operate in a transverse electromagnetic mode, the first planar resonator being operable at a first resonant frequency and the second planar resonator being operable at a second resonant frequency;

at least one feed line connected to the first planar resonator and being capable of providing a signal to the first planar resonator; and an inductive planar coupling strip directly connected to the first and second planar resonators, wherein the inductive planar coupling strip is configured to operate in a transverse electromagnetic mode and is capable of conveying portions of the signal from the first planar resonator to the second planar resonator, wherein the inductive planar coupling strip is connected to the first planar resonator at a first connection point and the second planar at a second connection point, and the inductive planar coupling strip inductively couples the first and second planar resonators and provides a coupling value of at least 0.12, wherein the inductive planar coupling strip is entirely electrically conductive, and wherein each of the first and second connection points is at a non-zero potential.

39. The apparatus of claim 38, wherein the inductive planar coupling strip is configured to convey the signal across a magnetic field.

40. The apparatus of claim 38, wherein the first planar resonator has a length of less than one quarter of its resonant frequency.

41. The apparatus of claim 38, wherein the inductive planar coupling strip has a dimension of at least 1 millimeter.

42. The apparatus of claim 38, wherein the inductive planar coupling strip is representable as an inductance having a nano-henry (nH) value.

43. An apparatus comprising:

an inductive coupling device configured to operate in a transverse electromagnetic mode and configured to directly connect at least two resonators, the two resonators being operable at a first resonant frequency and a second resonant frequency, respectively; and wherein the inductive coupling device is connected to a first resonator of the two resonators at a first connection point and to a second resonator of the two resonators at a second connection point, and the inductive coupling device inductively couples the first and second resonators and provides a coupling value of at least 0.12, wherein the inductive coupling device is entirely electrically conductive, and wherein each of the first and second connection points is at a non-zero potential.

44. The apparatus of claim 43, wherein each resonator is configured to operate in a transverse electromagnetic mode.

45. The apparatus of claim 43, wherein each resonator is configured to operate in a transverse electric mode.

46. The apparatus of claim 43, wherein the coupling device is configured to convey a signal across a magnetic field.

47. The apparatus of claim 43, wherein at least one of the two resonators has a length of less than one quarter of its resonant frequency wavelength.

48. The apparatus of claim 43, wherein the inductive coupling device has a dimension of at least 1 millimeter.

49. The apparatus of claim 43, wherein the inductive coupling device is representable as an inductance having a nanohenry (nH) value.

* * * * *